US012595633B2

(12) United States Patent
Knott

(10) Patent No.: US 12,595,633 B2
(45) Date of Patent: Apr. 7, 2026

(54) TELESCOPING DRAIN

(71) Applicant: Jerry Knott, Owensboro, KY (US)

(72) Inventor: Jerry Knott, Owensboro, KY (US)

( * ) Notice: Subject to any disclaimer, the term of this patent is extended or adjusted under 35 U.S.C. 154(b) by 193 days.

(21) Appl. No.: 18/589,087

(22) Filed: Feb. 27, 2024

(65) Prior Publication Data

US 2025/0270778 A1 Aug. 28, 2025

(51) Int. Cl.
*E02B 11/00* (2006.01)
*E03F 5/04* (2006.01)

(52) U.S. Cl.
CPC ..... *E02B 11/005* (2013.01); *E03F 5/04* (2013.01)

(58) Field of Classification Search
CPC ..... E02B 11/005; E02B 11/00; E03F 5/04; E03F 5/0413; A01G 25/00; A01G 25/06; A01G 29/00
See application file for complete search history.

(56) References Cited

U.S. PATENT DOCUMENTS 1,457,637 A * 6/1923 Sievers ..... E02B 11/005 285/298
1,792,345 A * 2/1931 Williams ..... E03F 5/0407 285/391
3,317,144 A * 5/1967 Muschett ..... B05B 15/74 285/302
4,274,592 A * 6/1981 Westhusin ..... B05B 15/658 239/200
2006/0278729 A1* 12/2006 Humrickhouse ..... A01G 25/06 239/73
2011/0064521 A1 3/2011 Schafer
2013/0048121 A1* 2/2013 Glazik ..... E03F 5/0404 137/577
2021/0400890 A1* 12/2021 Tuser ..... A01G 25/02

OTHER PUBLICATIONS

Legal, Hickenbottom, Inc., Retrieved on Nov. 23, 2023. Retrieved from the Internet: <https://hickenbottominc.com/legal/>, 2 pages.

(Continued)

*Primary Examiner* — Amber R Anderson
*Assistant Examiner* — Stacy N Lawson
(74) *Attorney, Agent, or Firm* — McKee, Voorhees & Sease, PLC

(57) ABSTRACT

A telescoping riser assembly and/or telescoping riser system can be used to drain water from an agricultural field without hindering agricultural activities performed on the agricultural field and without damaging any aspect(s) of the assembly. The telescoping drain riser assembly can include underground piping wherein a cylindrical member of the telescoping riser assembly is configured to selectively telescopically extend from and/or retract into the underground piping. The telescoping riser assembly can further comprise a vibration isolator, a snap cap, and a main cap. The vibration isolator can engage and/or be integrally formed with the underground piping and can slidingly interact with the cylindrical member to facilitate the telescopic extension and/or retraction. The main cap can be attached to an end of the cylindrical member via the snap cap. The main cap can fit firmly to the ground when the cylindrical member is fully retracted into the underground piping.

14 Claims, 20 Drawing Sheets

(56) References Cited

OTHER PUBLICATIONS

Operation & Installation: How to set up and use your Hickenbottom Inlet., Installation, Hickenbottom Drain Inlets., Retrieved on Nov. 23, 2023. Retrieved from the Internet: <hickenbottom.ca/installation.php>, 2 pages.

Operation & Installation: How to set up and use your Hickenbottom Inlet., Operation, Hickenbottom Drain Inlets., Retrieved on Nov. 23, 2023. Retrieved from the Internet: <hickenbottom.ca/installation.php>, 2 pages.

* cited by examiner

TELESCOPING DRAIN

TECHNICAL FIELD

The present disclosure relates generally to an apparatus, system, and/or a corresponding method of use/manufacture having applications in at least the agricultural and tile drainage industries. More particularly, but not exclusively, the present disclosure relates to a telescoping drain riser for use as part of a tile drainage operation.

BACKGROUND

The background description provided herein gives context for the present disclosure. Work of the presently named inventors, as well as aspects of the description that may not otherwise qualify as prior art at the time of filing, are neither expressly nor impliedly admitted as prior art.

Tile drainage is a form of drainage used in agriculture to remove excess water from agricultural fields. Excess surface water that accumulates on agricultural fields can be drained via pumping, use of ditches, and/or other methods. Tile drainage is an effective way to drain sub-surface water from agricultural fields as well as water that accumulates on agricultural fields above ground. Tile drainage operations can help control erosion of agricultural fields.

Tile drainage operations often involve inserting underground tubing/piping beneath the surface of the soil of an agricultural field. Such tubing/piping can be used to drain water from agricultural fields to eliminate and/or mitigate erosion of the ground. Existing tile drainage operations include risers that are often tube-shaped. Such risers extend up from the ground wherein the risers are operatively attached to aspect(s) of the tile drainage operation (which can include the underground tubing/piping) that are located underneath the surface of the ground. Such risers often extend to a height 3 to 5 feet above the surface of the ground. Additionally, a typical agricultural field with a tile drainage system may include 30 risers.

While the risers extending above the surface of the ground may be beneficial and/or necessary for the tile drainage operation to function properly, such risers extending above the ground creates problems at particular times throughout the agricultural process. For instance, problems arise when planting, harvesting, fertilizing, plowing, and/or performing any other agricultural activity that requires an agricultural vehicle and/or agricultural implement to traverse an agricultural field. Farmers controlling agricultural vehicles/implements and/or autonomous agricultural vehicles/implements are forced to navigate and/or steer around the risers in order to perform an agricultural activity such as planting or harvesting so as not to run into and/or over the risers which could result in damage to the riser and/or to the agricultural equipment. Additionally, during harvest when crops are fully developed, it can be difficult and/or impossible to see the risers which leads to farmers often running into the risers with agricultural equipment resulting in loss of time, effort, and money spent repairing and/or replacing said risers or agricultural equipment. Navigating around such risers leads to an increase in the amount of time needed to perform the agricultural activity, an increase in the effort involved in performing the agricultural activity, and can also lead to lower yields as less seed may be planted and/or it may be more difficult to harvest crops properly due to crop rows being curved and/or missing. An increase in time and effort needed to perform agricultural activities results in greater costs for the farmer based on greater fuel consumption to power the agricultural vehicles/implements for a longer period of time, more money to be paid in wages to hired laborers, as well as other reasons. A decrease in yields leads to less revenue for the farmer. Thus, these risers extending out of the ground can affect a farmer financially.

With the evolution of agricultural implements getting bigger and bigger and also being able to service more and more rows of crops in wider swaths, the problem of navigating around these risers has only been exacerbated. For example, while 6-row or 12-row planters were perhaps more common years ago, now 16-row and 24-row planters are common as well as even larger planters. Larger agricultural equipment is less maneuverable which causes more issues when navigating around the risers.

One existing way farmers have dealt with this issue of needing to navigate around risers is to remove the above-ground portion of the risers when performing an agricultural activity. However, when the above-ground portion of the risers is removed (i.e., stripped away from the surface of the ground), an open end of the underground tubing/piping is left exposed. Therefore, if the risers are removed during agricultural activities such as planting and/or harvesting, when the agricultural equipment passes over and/or comes in contact with the exposed underground tubing/piping, said agricultural equipment will damage the exposed tubing/piping. This could result in time, effort, and money needing to be spent to repair and/or replace aspects of the tile drainage operation. Additionally, when the above-ground portion of the risers are removed when performing an agricultural activity, debris is able to enter the exposed end of the underground tubing/piping. Debris entering the underground tubing/piping and/or entering other aspects of the tile drainage operation can negatively affect the functionality and efficiency of the water drainage as well as potentially damage aspects of the tile drainage operation. Thus, debris entering the underground tubing/piping and/or other aspects of the tile drainage operation could result in the need to clean aspects of the tile drainage operation as well as repair and/or replace aspects of the tile drainage operation. Such cleaning, repair, and/or replacement would cost a farmer time, effort, and money. Additionally, if the tile drainage operation is not draining water properly, due to damage and/or buildup of debris, the farmer's yields, and thus the farmer's revenue, would be negatively affected.

Thus, there exists a need in the art for a drain riser assembly that does not need to be navigated around when performing an agricultural activity in an agricultural field. There exists an additional need in the art for a drain riser assembly that does not allow damage to aspect(s) of the tile drainage system or allow debris to enter the tile drainage operation when performing an agricultural activity in an agricultural field.

SUMMARY

The following objects, features, advantages, aspects, and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

It is a primary object, feature, and/or advantage of the present disclosure to improve on or overcome the deficiencies in the art.

It is a further object, feature, and/or advantage of the present disclosure to provide a telescoping drain riser assembly wherein a top riser can be extended from and retracted into a bottom riser and/or underground piping.

It is a further object, feature, and/or advantage of the present disclosure to allow for proper water drainage from an agricultural field without hindering the ability to perform agricultural activities on the agricultural field. Aspects and/or embodiments of the present disclosure allow for a top riser to be extended above ground when agricultural activities are not being performed on an agricultural field and retracted below ground when agricultural activities are being performed on an agricultural field. Thus, aspects and/or embodiments of the present disclosure allow for a farmer to not have to navigate around an extended riser when performing agricultural activities. This allows farmers to perform agricultural activities in a more fuel-efficient manner, faster, and with less effort. Therefore, the farmer can limit costs related to fuel consumption and/or payment to hired laborers. Additionally, since farmers and/or operators of agricultural equipment do not have to navigate around extended risers in an agricultural field, rows of crops can remain straight and uninterrupted rather than possibly being curved and/or interrupted. This leads to maximization of yields which leads to higher revenue for the farmer. Thus, aspects and/or embodiments of the present disclosure limit costs and maximize revenue for a farmer.

It is a further object, feature, and/or advantage of the present disclosure to allow for proper water drainage and the ability to perform agricultural activities without damaging any aspect(s) of the water drainage system and without allowing unwanted debris to enter aspect(s) of the water drainage system. Aspects and/or embodiments of the present disclosure include a main cap on one end of the top riser wherein the main cap is configured to be flush with the ground and/or configured to fit firmly to the ground when the top riser is fully retracted such that the top riser is underground. The main cap is configured to protect aspect(s) of the drainage system from damage and from debris when agricultural activities are being performed. Thus, farmers do not have to navigate around riser locations for fear of damaging the riser, and/or other aspects of the drainage system, or for fear of causing unwanted debris to enter piping and/or other aspects of the drainage system. Rather, a farmer can perform agricultural activities normally as if the risers were not present at all. Again, this allows farmers to perform agricultural activities in a more fuel-efficient manner, faster, and with less effort. Therefore, the farmer can limit costs related to fuel consumption and/or payment of hired laborers. Further, the main cap protects the riser assembly, and/or other aspects of the drainage system, from damage and unwanted debris. Thus, aspects and/or embodiments of the present disclosure allow a farmer to not have to spend time and/or money repairing and/or replacing aspects of the drainage system. Also, farmers do not have to spend time and/or money removing unwanted debris from the riser assemblies and/or other aspects of the drainage system. Accumulation of debris in the riser assemblies and/or other aspects of the drainage system can cause the drainage system to not function properly, which can lead to even more time, money, and effort needed to repair or replace aspects of the drainage system. Additionally, since farmers and/or operators of agricultural equipment do not have to navigate around riser locations, rows of crops can remain straight and uninterrupted rather than being curved and/or interrupted. This leads to maximization of yields which leads to higher revenue for the farmer. Furthermore, damage and buildup of debris can lead to the drainage system not functioning properly, which can hurt crop yields and, thus, hurt the farmer's revenue. Therefore, by protecting the riser assemblies and/or other aspects of the drainage system from damage and from buildup of debris, aspects and/or embodiments of the present disclosure disclosed herein allow a farmer to maximize revenue. Thus, aspects and/or embodiments of the present disclosure limit costs and maximize revenue for a farmer.

It is a further object, feature, and/or advantage of the present disclosure to provide a vibration isolator that is configured to slidingly engage the top riser of the drain riser assembly.

It is a further object, feature, and/or advantage of the present disclosure to provide a locking mechanism on the top riser such that the top riser can be locked in place relative to the vibration isolator and/or to the underground piping.

It is a further object, feature, and/or advantage of the present disclosure to provide a telescoping riser system comprising one or more telescoping riser assemblies wherein a user can interact with a human-machine interface (HMI) to determine and/or monitor the location of each of the one or more telescoping riser assemblies.

It is a further object, feature, and/or advantage of the present disclosure to eliminate the need for an orifice in the bottom riser that goes into the ground. The orifice in the bottom riser can restrict water flow and is included only to comply with archaic governmental regulations. While the orifice can still be used in combination with the telescoping riser systems described herein, it is more beneficial to either (i) eliminate the orifice in whole or (ii) move the orifice to the top riser.

The apparatus(es) disclosed herein can be used in a wide variety of applications. For example, the drain riser assembly disclosed herein could be used as part of any tile drainage system. Additionally, the telescoping riser system disclosed herein could be used in a wide variety of environments other than agricultural fields. For example, such a system could be used for water drainage in any setting such as any field, yard, sports and recreation area, construction site, and the like.

It is preferred the apparatus be safe, cost effective, and durable. For example, some of the purposes/objectives/advantages of the present disclosure, which are noted above, include minimizing costs and maximizing revenue. Additionally, aspects and/or embodiments of the present disclosure can be constructed from plastic and/or metal, which provides safety, cost effectiveness, and durability. The apparatus(es) and/or system(s) described herein can be adapted to resist thermal transfer, electric conductivity, and/or failure (e.g. cracking, crumbling, shearing, creeping) due to excessive and/or prolonged exposure to tensile, compressive, and/or balanced forces acting on the apparatus(es).

At least one embodiment disclosed herein comprises a distinct aesthetic appearance. Ornamental aspects included in such an embodiment can help capture a consumer's attention and/or identify a source of origin of a product being sold. Said ornamental aspects will not impede functionality of the present disclosure.

Methods can be practiced which facilitate use, manufacture, assembly, maintenance, and repair of an apparatus and/or system which accomplishes some or all of the previously stated objectives.

Apparatus(es) described herein, including the telescoping riser assembly, can be incorporated into systems which accomplish some or all of the previously stated objectives. Additionally, system(s) described herein, including the telescoping riser system, can be incorporated into larger designs which accomplish some or all of the previously stated objectives.

According to some aspects of the present disclosure, a drain riser assembly for use with water drainage from an agricultural field comprises: a cylindrical member; a vibration isolator configured to slidingly interact with the cylindrical member; a snap cap removably attachable to one end of the cylindrical member; and a main cap removably attachable to the snap cap.

According to at least some aspects of the present disclosure, the cylindrical member comprises opposing guide slots.

According to at least some aspects of the present disclosure, the vibration isolator is a removable bushing comprising opposing tabs.

According to at least some aspects of the present disclosure, the opposing guide slots of the cylindrical member are configured to slidingly engage the opposing tabs of the bushing.

According to at least some aspects of the present disclosure, the bushing comprises a body having an outer surface and an inner surface, further wherein the bushing is configured to engage underground piping via the outer surface, and/or flange(s) thereof, and slidingly interact with the cylindrical member via the inner surface.

According to at least some aspects of the present disclosure, when the bushing is engaged with the underground piping, the cylindrical member is capable of sliding relative to the bushing such that the cylindrical member can telescopically extend from and retract into the underground piping, further wherein a body of the main cap fits firmly to the ground when the main cap is attached to the snap cap, the snap cap is attached to the cylindrical member, and the cylindrical member is fully retracted into the underground piping.

According to at least some aspects of the present disclosure, the snap cap comprises opposing slots wherein the slots of the snap cap are configured to slidingly interact with a back side of the guide slots of the cylindrical member.

According to at least some aspects of the present disclosure, the snap cap further comprises opposing protrusions and the cylindrical member comprises two or more apertures, further wherein each of the opposing protrusions are configured to engage one of the two or more apertures when the snap cap is attached to the cylindrical member.

According to at least some aspects of the present disclosure, the cylindrical member comprises a locking mechanism that allows the cylindrical member to be locked in place relative to the vibration isolator.

According to at least some aspects of the present disclosure, the snap cap comprises an overmold and the main cap comprises a connection member, further wherein the overmold and the connection member can matingly engage to attach the snap cap to the main cap.

According to at least some aspects of the present disclosure, the cylindrical member comprises first, second, and third sections, further wherein the first and second sections are separated via a first cut line and the second and third sections are separated via a second cut line.

According to at least some aspects of the present disclosure, the vibration isolator comprises one or more tabs integrally formed with underground piping.

According to at least some aspects of the present disclosure, the cylindrical member is capable of sliding relative to the one or more tabs integrally formed with the underground piping such that the cylindrical member can telescopically extend from and retract into the underground piping, further wherein a body of the main cap fits firmly to the ground when the main cap is attached to the snap cap, the snap cap is attached to the cylindrical member, and the cylindrical member is fully retracted into the underground piping.

According to at least some aspects of the present disclosure, a telescoping riser assembly for use with water drainage from an agricultural field comprises: a bottom riser positioned generally underground; a vibration isolator configured to interact with or be integrally formed with the bottom riser; and a top riser configured to slidingly interact with the vibration isolator to extend from and retract into the bottom riser in a telescopic manner.

According to at least some aspects of the present disclosure, the vibration isolator is a removable bushing configured to interact with the bottom riser.

According to at least some aspects of the present disclosure, the vibration isolator comprises one or more tabs integrally formed with the bottom riser.

According to at least some aspects of the present disclosure, the bottom riser and the top riser are generally cylindrical.

According to at least some aspects of the present disclosure, a telescoping riser system for use with water drainage from an agricultural field comprises: at least one drain riser assembly of claim 1, wherein each of the at least one drain riser assemblies is positioned in an agricultural field.

According to at least some aspects of the present disclosure, the system further comprises a human-machine interface (HMI) operationally connected to each of the at least one drain riser assemblies.

According to at least some aspects of the present disclosure, the system further comprises a positioning system operationally connected to each of the at least one drain riser assemblies and/or to the HMI to determine and/or monitor the location of each of the at least one drain riser assemblies.

These and/or other objects, features, advantages, aspects, and/or embodiments will become apparent to those skilled in the art after reviewing the following brief and detailed descriptions of the drawings. Furthermore, the present disclosure encompasses aspects and/or embodiments not expressly disclosed but which can be understood from a reading of the present disclosure, including at least: (a) combinations of disclosed aspects and/or embodiments and/or (b) reasonable modifications not shown or described.

BRIEF DESCRIPTION OF THE DRAWINGS

Several embodiments in which the present disclosure can be practiced are illustrated and described in detail, wherein like reference characters represent like components throughout the several views. The drawings are presented for exemplary purposes and may not be to scale unless otherwise indicated.

As will be understood, any of the aspects of any of the embodiments shown and/or described herein could be combined with one another to form any number of embodiments, whether expressly disclosed or not, which would be understood by one skilled in the art.

Figure 1:
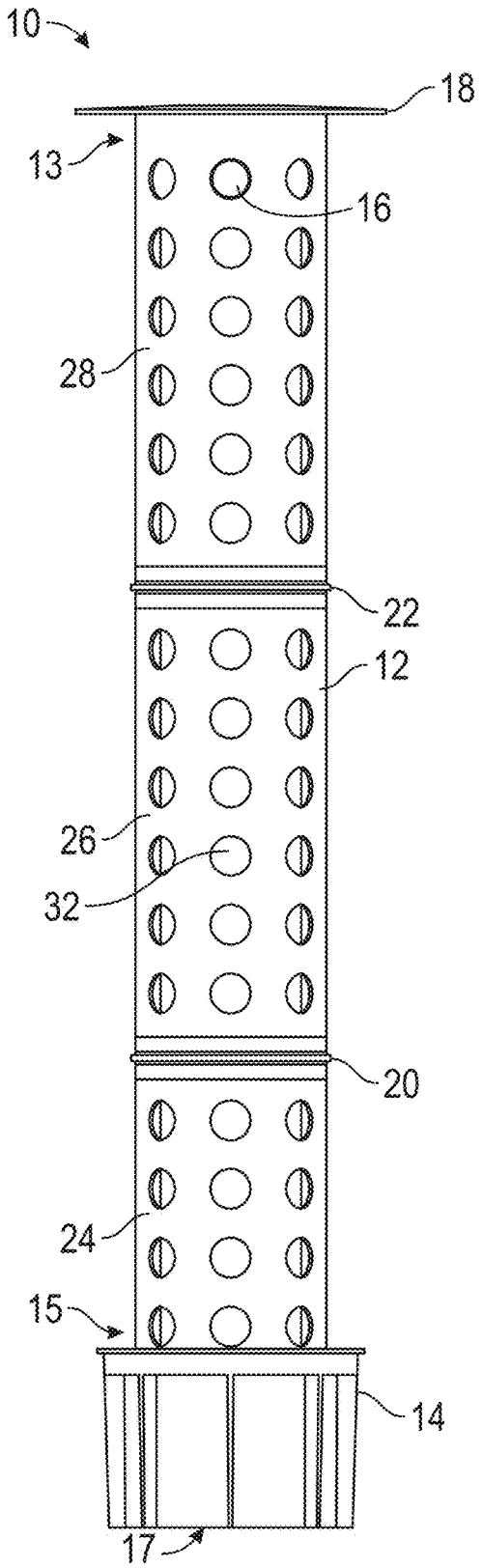
FIG. 1 shows a front elevation view of aspects of an example drain riser assembly, wherein a snap cap and main cap are fully attached to a cylindrical member.

An artisan of ordinary skill in the art need not view, within isolated figure(s), the near infinite number of distinct permutations of features described in the following detailed description to facilitate an understanding of the present disclosure.

DETAILED DESCRIPTION

The present disclosure is not to be limited to that described herein. Mechanical, electrical, chemical, procedural, and/or other changes can be made without departing from the spirit and scope of the present disclosure. No features shown or described are essential to permit basic operation of the present disclosure unless otherwise indicated.

Unless defined otherwise, all technical and scientific terms used herein have the same meaning as commonly understood by one of ordinary skill in the art to which embodiments of the present disclosure pertain.

The terms "a," "an," and "the" include both singular and plural referents.

The term "or" is synonymous with "and/or" and means any one member or combination of members of a particular list.

The terms "invention" or "present invention" are not intended to refer to any single embodiment of the particular invention but encompass all possible embodiments as described in the specification and the claims.

The term "about" as used herein refers to slight variations in numerical quantities with respect to any quantifiable variable. Inadvertent error can occur, for example, through use of typical measuring techniques or equipment or from differences in the manufacture, source, or purity of components.

The term "substantially" refers to a great or significant extent. "Substantially" can thus refer to a plurality, majority, and/or a supermajority of said quantifiable variable, given proper context.

The term "generally" encompasses both "about" and "substantially."

The term "configured" describes structure capable of performing a task or adopting a particular configuration. The term "configured" can be used interchangeably with other similar phrases, such as "constructed", "arranged", "adapted", "manufactured", and the like.

Terms characterizing sequential order, a position, and/or an orientation are not limiting and are only referenced according to the views presented.

The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, subcombinations, or the like that would be obvious to those skilled in the art.

The term "agricultural equipment" encompasses any type of machinery associated with the agriculture industry. For example, both agricultural vehicles and agricultural implements are encompassed by the term "agricultural equipment".

The term "agricultural activity" encompasses any type of agricultural operation performed in an agricultural field including, but not limited to, planting, harvesting, fertilizer application, pesticide application, herbicide application, plowing, ripping, discing, drilling, and the like. Agricultural activities can be performed with or without agricultural equipment.

As used herein, the term "exemplary" refers to an example, an instance, or an illustration, and does not indicate a most preferred embodiment unless otherwise stated.

Figure 2:
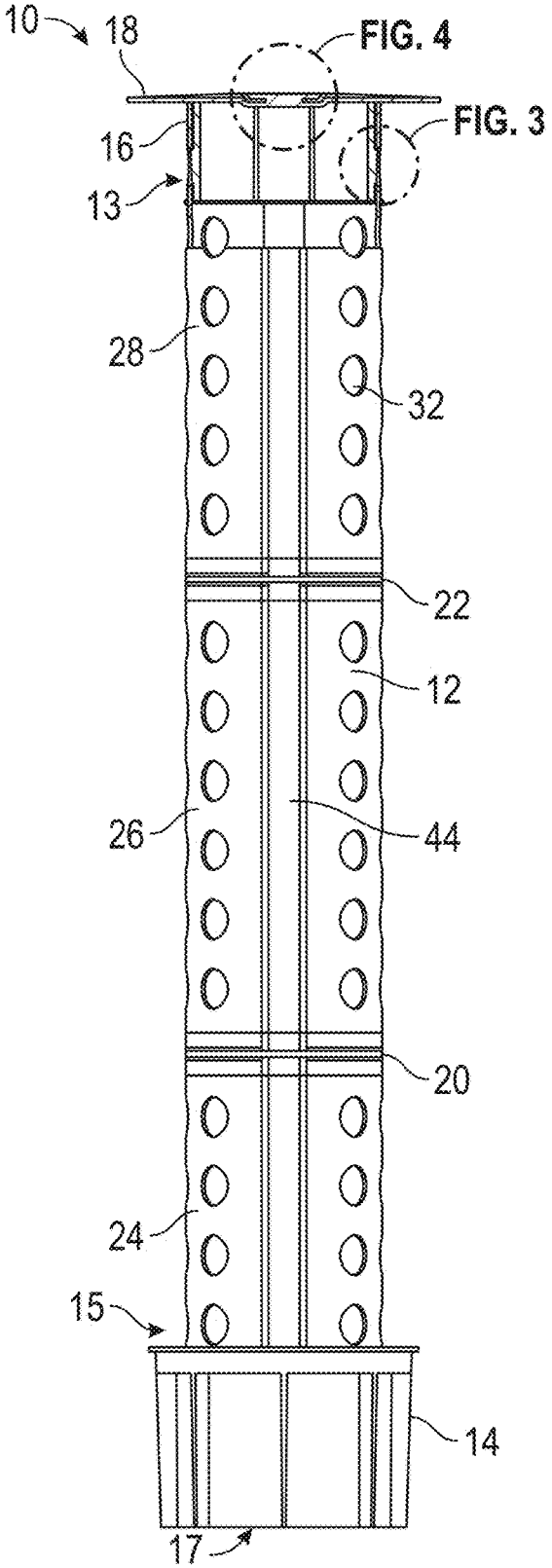
FIG. 2 shows a side elevation view of aspects of the drain riser assembly of FIG. 1, wherein the snap cap and/or main cap are not fully attached to the cylindrical member.

Referring now to the figures, various aspects of an example embodiment of a drain riser assembly 10 are shown in FIGS. 1-4. FIG. 1 shows a front elevation view of a drain riser assembly 10 according to some embodiments. The drain riser assembly 10 can also be referred to herein as the telescoping riser assembly 10. Thus, "drain riser assembly 10" and "telescoping riser assembly 10" can be used interchangeably. As shown in FIG. 1, according to some embodiments, the drain riser assembly 10 can comprise a cylindrical member 12, a vibration isolator 14, a snap cap 16, and a main cap 18. The cylindrical member 12 can include a first end 13 and a second end 15. The cylindrical member can include one or more apertures 32. The aperture(s) 32 can be generally circular according to some embodiments, however, they could be any suitable shape. The apertures 32 can number from one to N where N is any number greater than one. It should be noted that while the example cylindrical member 12 shown in FIGS. 1-4 includes many apertures 32, only one aperture is labeled in FIGS. 1 and 2 for the sake of clarity. The snap cap 16 is removably attachable to one end of the cylindrical member 12. More detail regarding such attachment is included below. The main cap 18 is removably attachable to the snap cap 16, such that when the main cap 18 is attached to the snap cap 16 and the snap cap 16 is fully attached to the cylindrical member 12, the main cap 18 forms a protective cap on one end of the cylindrical member 12. The cylindrical member 12 can be inserted into, and slidingly engage, the vibration isolator 14. According to some embodiments, the telescoping riser assembly 10 further comprises underground piping 94. According to some embodiments, the vibration isolator 14 can be and/or comprise a bushing 17 as is shown in FIGS. 1 and 2. According to some embodiments, the vibration isolator 14 can be and/or comprise one or more tabs 99 integrally formed as part of the underground piping 94. More detail regarding the sliding connection between the cylindrical member 12 and the vibration isolator 14 is included below.

Further, as shown in FIG. 1, according to some embodiments, the cylindrical member 12 can be divided into three sections comprising a first section 24, a second section 26, and a third section 28. According to some embodiments, the first and second sections 24, 26 can be divided by a first cut line 20 and the second and third sections 26, 28 can be divided by a second cut line 22. The cylindrical member 12 can include any number of sections and/or any number of cut lines separating said sections according to some embodiments. Additionally, according to some embodiments, the cylindrical member 12 can comprise a single section with no cut lines.

FIG. 2 shows a side elevation view of the drain riser assembly 10 shown in FIG. 1, wherein the snap cap 16 is not fully attached to the cylindrical member 12. As shown in FIG. 2, according to some embodiments, the cylindrical member 12 can include opposing guide slots 44. Such guide slots 44 can span the length of the cylindrical member 12. Such guide slots 44 can be, resemble, and/or comprise a trough, ditch, U-shaped bend, and/or similar structure. While only one guide slot 44 is visible in FIG. 2, an identical guide slot 44 can be positioned on the opposite side of the cylindrical member 12.

Figure 3:
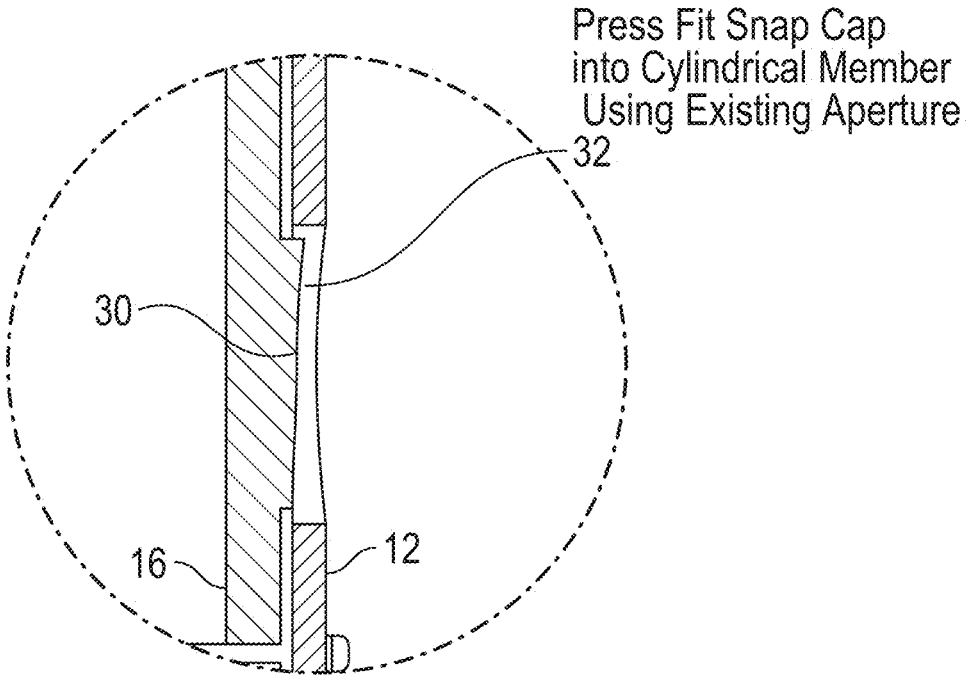
FIG. 3 shows a zoomed-in view of aspects of the drain riser assembly of FIG. 2, wherein aspect(s) of the snap cap are shown interacting with aspect(s) of the cylindrical member.

FIG. 3 shows a zoomed-in portion of the drain riser assembly 10 shown in FIG. 2. FIG. 3 shows a view of the snap cap 16 interacting with the cylindrical member 12 to achieve attachment of the snap cap 16 to the cylindrical member 12. According to some embodiments, the snap cap 16 comprises one or more protrusions 30 wherein each of the one or more protrusions 30 are configured to fit into and/or snap into an aperture 32 of the cylindrical member 12 in order to achieve attachment of the snap cap 16 to the cylindrical member 12. According to some embodiments, each protrusion 30 can be press fit into an aperture 32. While some embodiments include the snap cap 16 comprising two opposing protrusions 30, each of which are configured to fit into and/or snap into an aperture 32 of the cylindrical member 12, the snap cap 16 could have any number of protrusions ranging from one to N where N is any number greater than one. According to some embodiments, other types of connection means other than a protrusion fitting into and/or snapping into an aperture could be used, such connection means can include, but not limited to, screw(s), nut(s) and bolt(s), a threaded connection, other types of snap fit connection, and the like.

Figure 4:
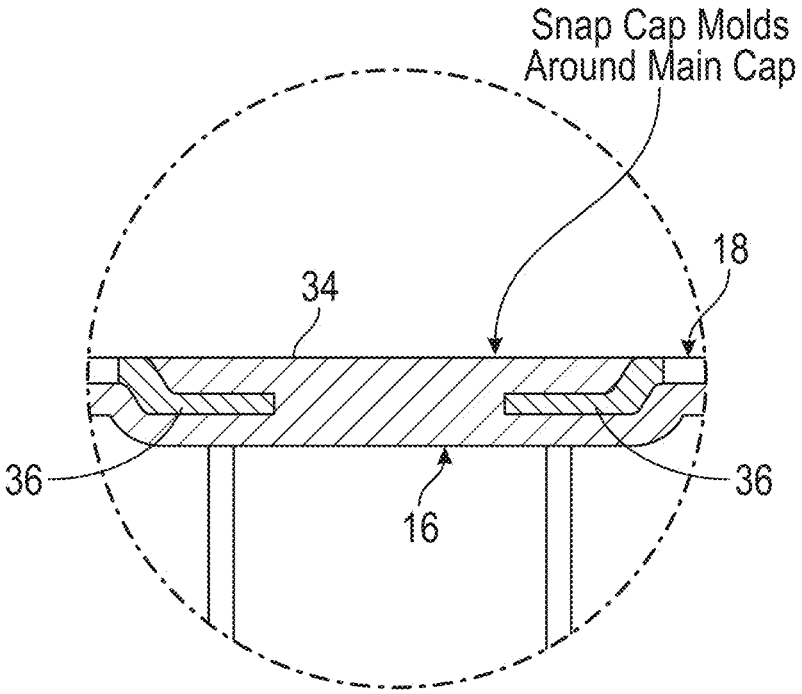
FIG. 4 shows a zoomed-in view of aspects of the drain riser assembly of FIG. 2, wherein aspect(s) of the snap cap are shown interacting with aspect(s) of the main cap.

FIG. 4 shows a zoomed-in portion of the drain riser assembly 10 shown in FIG. 2. FIG. 4 shows a view of the snap cap 16 interacting with the main cap 18 to achieve attachment of the snap cap 16 to the main cap 18. According to some embodiments, the snap cap 16 can include an overmold 34 that molds around aspect(s) of the main cap 18 in order to achieve attachment of the main cap 18 to the snap cap 16. As shown in FIG. 4, according to some embodiments, the main cap 18 can include a connection member 36, wherein the connection member 36 is configured to interact with the overmold 34 of the snap cap 16 to facilitate attachment and/or connection of the snap cap 16 and main cap 18. The overmold 34 and connection member 36 are described in greater detail below.

According to some embodiments, the cylindrical member 12, vibration isolator 14, snap cap 16, and main cap 18 can be integrally formed such that all aspects of the drain riser assembly 10 shown in FIGS. 1 and 2 are formed as a single structure. According to some embodiments, the cylindrical diameter of any such components including the cylindrical member 12, vibration isolator 14, snap cap 16, and/or main cap 18 can be any suitable length. For example, according to various embodiments, the cylindrical diameter of any of these components including the cylindrical member 12, vibration isolator 14, snap cap 16, and/or main cap 18 could be 4, 6, 8, 10, or 12 inches. Additionally, if aspects of the drain riser assembly 10 are integrally formed as a single structure, according to some embodiments, the cylindrical diameter thereof can be any suitable length. For example, according to various embodiments, the cylindrical diameter of the integrally formed aspects of the drain riser assembly 10 could be 4, 6, 8, 10, or 12 inches.

According to some embodiments, the cylindrical member 12, snap cap 16, and main cap 18 can be integrally formed as a single structure, and the vibration isolator 14 can be integrally formed with underground piping 94 as another structure. The vibration isolator 14 can be and/or comprise one or more tabs 99 integrally formed with the underground piping 94.

Additionally, according to some embodiments, the cylindrical member 12, snap cap 16, and main cap 18 can be integrally formed, and the vibration isolator 14 can be and/or comprise a bushing 17, as described herein, wherein said bushing 17 is configured to interact with the underground piping 94 and the cylindrical member 12.

Figure 5:
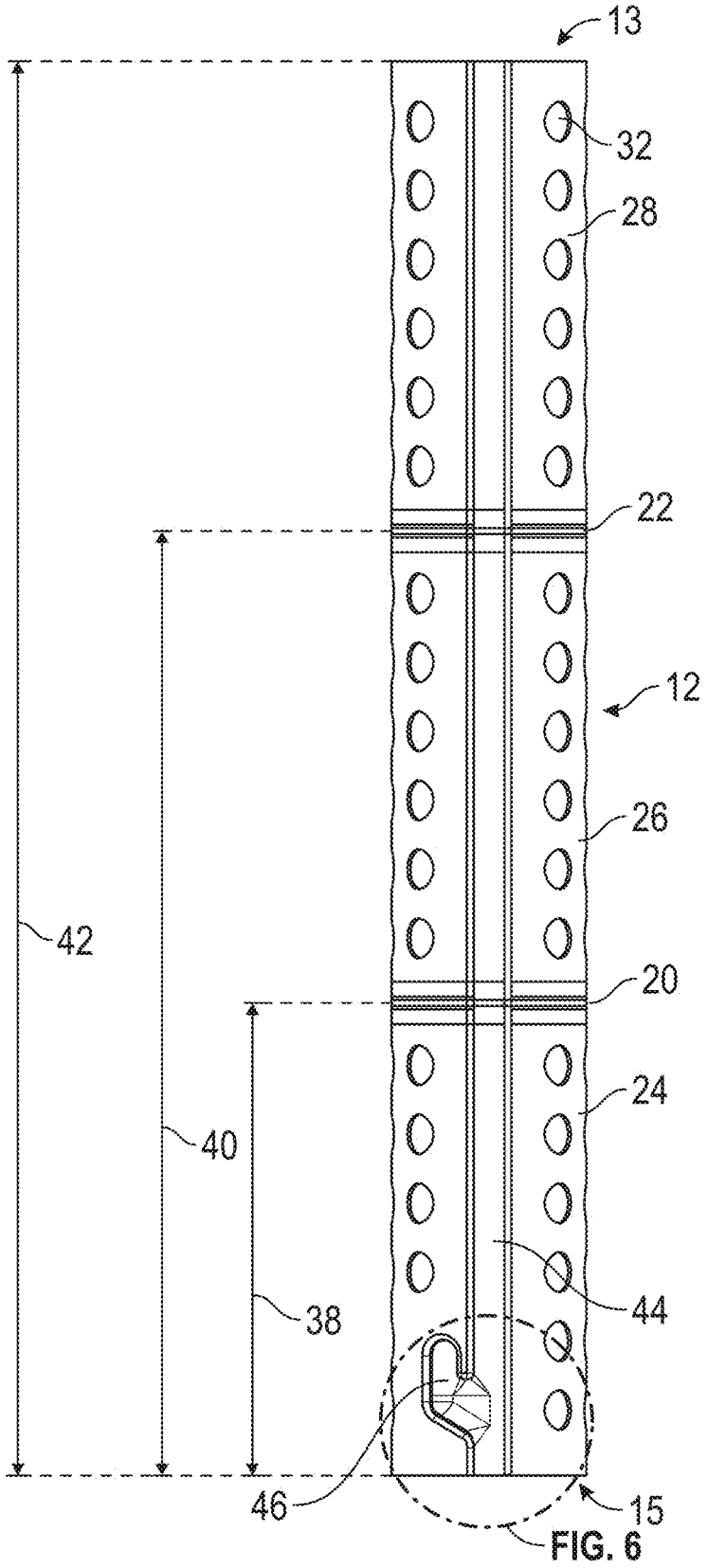
FIG. 5 shows a side elevation view of a cylindrical member of a drain riser assembly according to some aspects of the disclosure.

FIGS. 5-8 show various views and various aspect(s) of an example embodiment of a cylindrical member 12. The example embodiment of the cylindrical member 12 shown in FIGS. 5-8 could be used as the cylindrical member of the drain riser assembly 10 shown in FIGS. 1 and 2, according to some embodiments. FIG. 5 shows a side elevation view of the example embodiment of a cylindrical member 12. The example embodiment of the cylindrical member 12 shown in FIG. 5 is configured to be telescopically extendable from and retractable into underground piping 94. The underground piping 94 can be included as part of the drain riser assembly 10 according to some embodiments. Additionally, the term underground piping 94 can also be referred to herein as bottom riser 94 such that the terms "underground piping 94" and "bottom riser 94" can be used interchangeably. Further, the term cylindrical member 12 can be referred to herein as top riser 12 such that the terms "cylindrical member 12" and "top riser 12" can be used interchangeably. Such underground piping 94 is generally similar and/or identical to the cylindrical member 12 according to some embodiments. According to some embodiments, the cylindrical member 12 and underground piping 94 can be generally vertically oriented with relation to the ground. Thus, the underground piping 94 can extend in a generally downward direction from the surface of the ground at a vertical orientation wherein one end of the underground piping 94 is positioned at the surface of the ground and is exposed such that said end can receive the bushing 17 and/or cylindrical member 12 and the other end of the underground piping 94 is underground. While the cylindrical member 12 and underground piping 94 are vertically oriented according to some embodiments, the cylindrical member 12 and underground 94 need not be vertically oriented according to all embodiments. According to some embodiments, the diameter of the underground piping 94 can be similar to, the same as, or slightly larger than the diameter of the cylindrical member 12 such that the cylindrical member 12 can extend from and/or retract into the underground piping 94 in a telescopic manner.

The height 38 of the first section 24 can be 12 inches according to some embodiments. The combined height 40 of the first section 24 and the second section 26 can be 24 inches according to some embodiments. The combined height 42 of the first, second, and third sections 24, 26, and 28 can be 36 inches according to some embodiments. Thus, according to some embodiments, each section of the cylindrical member 12 can be 12 inches in length. However, according to some embodiments, each section of the cylindrical member 12 could be any suitable length and/or the cylindrical member 12 itself could be any suitable length. Additionally, according to some embodiments, the diameter of each aperture 32 can be 1 inch. However, any suitably sized aperture could be included.

FIG. 5 further shows that the cylindrical member 12 can include a locking mechanism 46. The locking mechanism 46 can comprise a single locking mechanism or can include opposing locking mechanisms 46 located on opposite sides of the cylindrical member 12. Each locking mechanism 46 can be associated with a guide slot 44 of the cylindrical member 12. According to some embodiments, the locking mechanism 46 can be, resemble, and/or comprise a cutout and/or slot of some sort wherein a tab of the vibration isolator 14, such as a tab 53 of the bushing 17, is configured to be inserted into and captured in each locking mechanism 46 in order to lock and/or secure the cylindrical member 12 in place relative to the vibration isolator 14, wherein the vibration isolator 14 could be a bushing 17 according to some embodiments.

A user can twist and/or spin the cylindrical member 12 radially relative to the vibration isolator 14 and/or manipulate the cylindrical member in a vertical direction in order to insert and/or capture a tab of the vibration isolator 14, such as a tab 53 of the bushing 17, in each locking mechanism 46. When the cylindrical member 12 is locked and/or secured in place relative to the vibration isolator 14, the cylindrical member 12 is not able to move in terms of extension and/or retraction relative to the underground piping 94 and/or the vibration isolator 14. A user can twist, spin, and/or manipulate the cylindrical member 12 to release the tab of the vibration isolator 14, such as a tab 53 of the bushing 17, from each locking mechanism 46 such that the cylindrical member 12 is free, unlocked, and movable relative to the vibration isolator 14 and the underground piping 94. When the cylindrical member 12 is unlocked, the cylindrical member 12 is movable and/or slidable relative to the vibration isolator 14 and the underground piping 94 such that the cylindrical member 12 can telescopically extend from and retract into the vibration isolator 14 and/or underground piping 94. The cylindrical member 12 is configured to slidingly engage the vibration isolator 14 and/or the underground piping 94.

Figure 6:
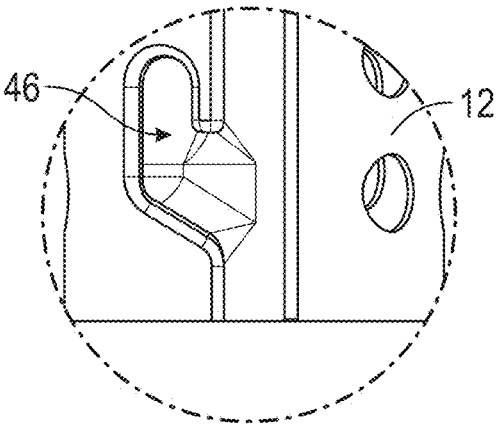
FIG. 6 shows a zoomed-in view of a locking mechanism of the cylindrical member of FIG. 5.

FIG. 6 provides a zoomed-in view of the locking mechanism 46 shown in FIG. 5.

Figure 7:
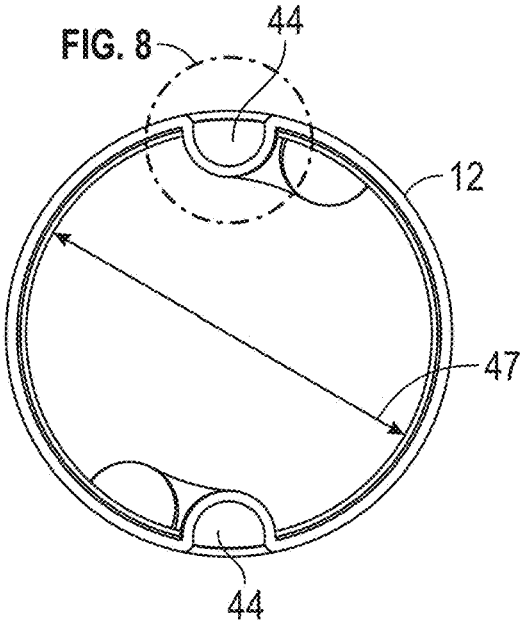
FIG. 7 shows a top plan view of the cylindrical member of FIG. 5.

FIG. 7 shows a top plan view of the cylindrical member 12. The U-shaped nature of each guide slot 44 can be seen in FIG. 7. As discussed in further detail below, each guide slot 44 can interact with a tab of the vibration isolator 14, such as a tab 53 of the bushing 17, to facilitate sliding the cylindrical member 12 relative to the vibration isolator 14. According to some embodiments, the diameter 47 of the cylindrical member 12 can be 4.957 inches. However, the diameter 47 of the cylindrical member 12 can be any suitable length. For example, according to various embodiments, the diameter 47 of the cylindrical member 12 could be 4, 5, 6, 8, 10, or 12 inches.

Figure 8:
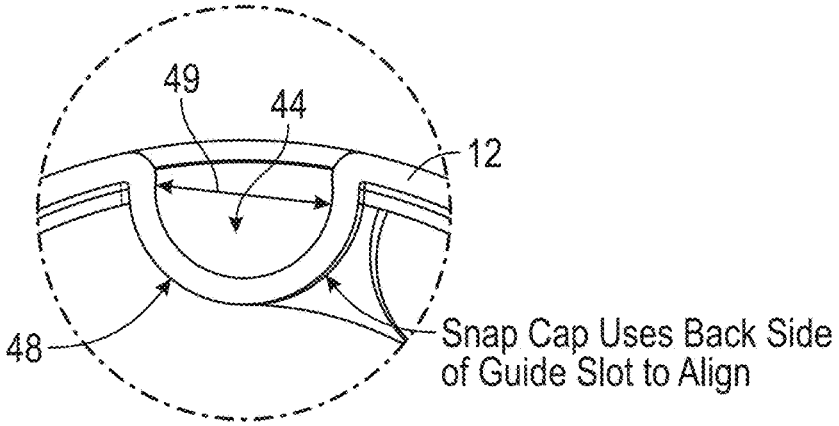
FIG. 8 shows a zoomed-in view of aspects of the cylindrical member of FIG. 7.

FIG. 8 shows a zoomed-in view of aspects of the cylindrical member 12 of FIG. 7 including a guide slot 44. As shown in FIG. 8, the diameter 49 of the guide slot 44 can be 0.790 inches according to some embodiments. However, the diameter 49 of the guide slot 44 can be any suitable length. FIG. 8 shows that each guide slot 44 comprises a back 48 according to some embodiments. According to some embodiments, the back 48 of each guide slot 44 can be used to facilitate attachment of the snap cap 16 and/or main cap 18 to the cylindrical member 12. The back 48 of each guide slot 44 can facilitate sliding engagement of the snap cap 16 with the cylindrical member 12. Further detail regarding interaction between the snap cap 16 and the cylindrical member 12 is provided below.

Figure 9:
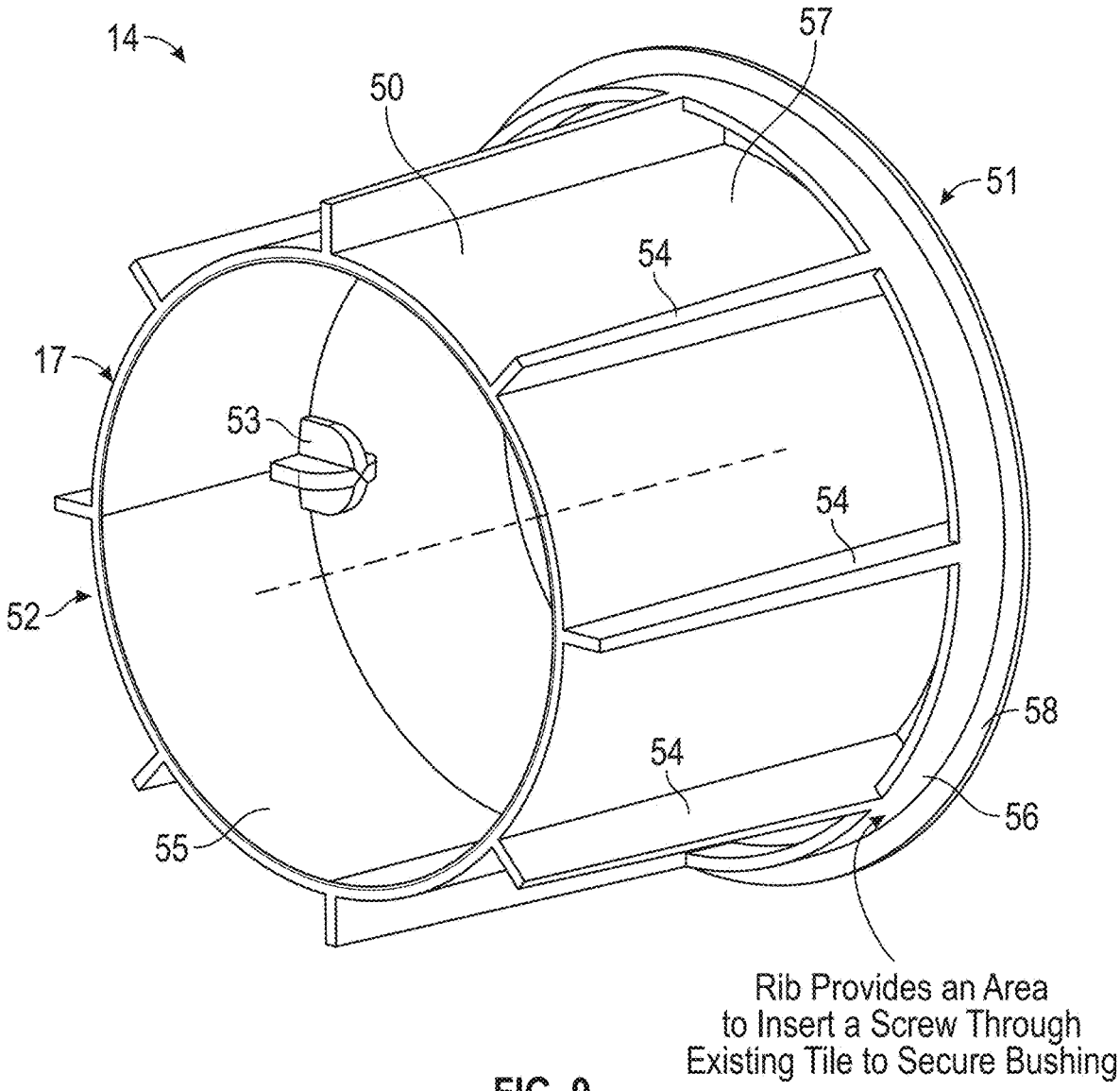
FIG. 9 shows a perspective view of a bushing according to some aspects of the disclosure.
Figure 10:
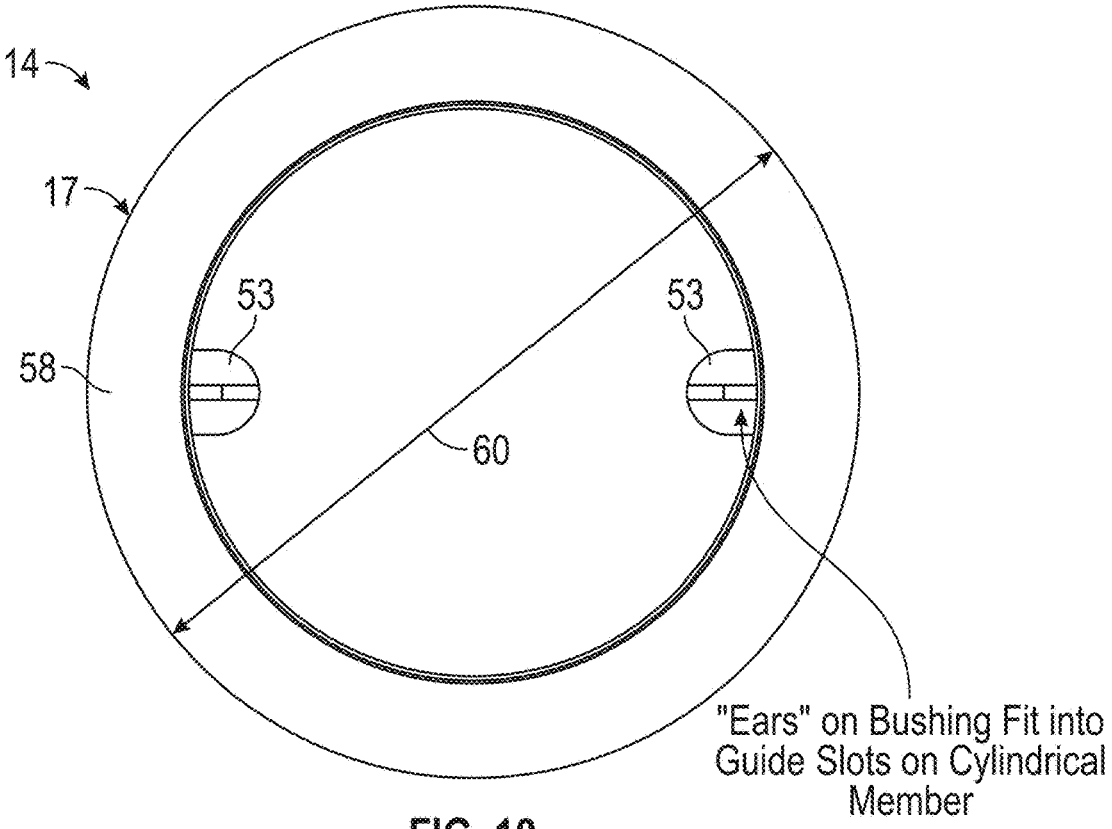
FIG. 10 shows a top plan view of the bushing of FIG. 9.
Figure 11:
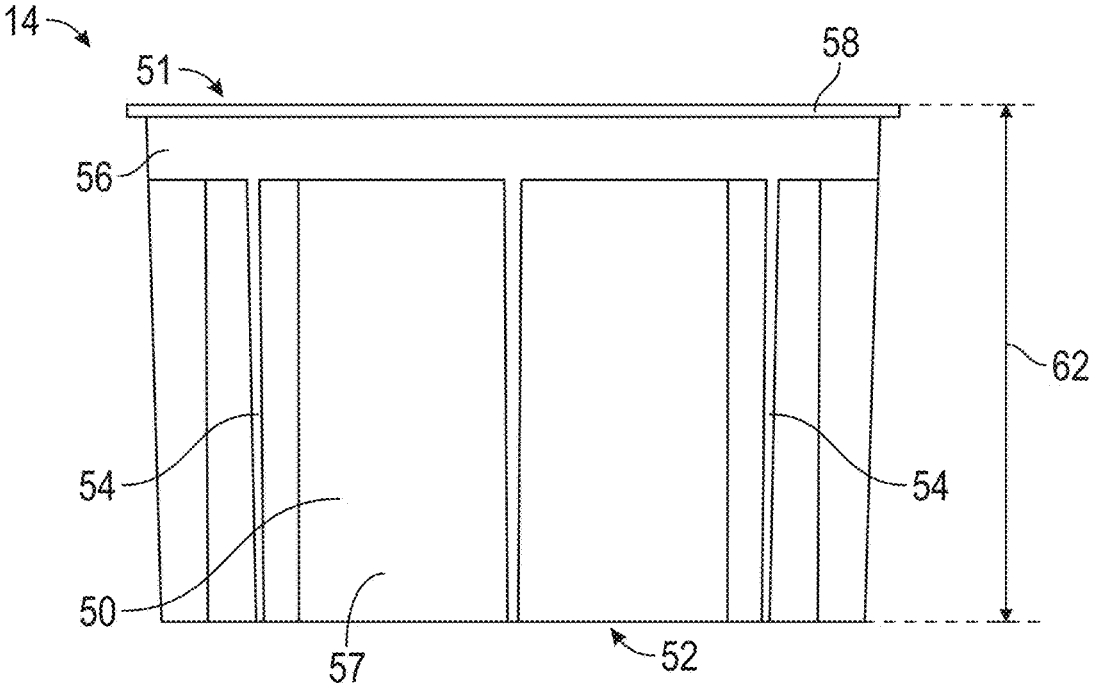
FIG. 11 shows a side elevation view of the bushing of FIG. 9.

FIGS. 9-11 show various views of an example embodiment of a bushing 17. As noted, according to some embodiments, the vibration isolator 14 can be and/or comprise a bushing 17. The example embodiment of the bushing 17 shown in FIGS. 9-11 could be used as the vibration isolator and/or bushing of the drain riser assembly 10 shown in FIGS. 1 and 2, according to some embodiments. FIG. 9 shows a perspective view of the example embodiment of a bushing 17. As shown in FIG. 9, the bushing 17 can include a bushing body 50 wherein the body has a first end 51, a second end 52, an inner surface 55, and an outer surface 57; one or more tabs 53 (as noted above); one or more flanges 54; a rib 56; and a rim 58.

The body 50 of the bushing 17 can be generally cylindrical such that it can receive the cylindrical member 12 via its inner surface 55. The first and second ends 51, 52 of the bushing can be open such that the cylindrical member 12 can slidingly pass through the interior of the bushing 17.

As noted, while the bushing 17 can include any number of tabs 53, as an example, the embodiment shown in FIGS. 9-11 includes two opposing tabs 53. Each tab 53 can be any sort of protrusion, knob, projection, or any similar structure. Each tab 53 can extend radially inwardly from the inner surface 55 of the bushing 17. Each tab 53 can be configured as four pieces, and/or "ears", forming a "cross" shape as shown in the example embodiment of FIG. 9. As noted, the tabs 53 can interact with the guide slots 44 of the cylindrical member 12 to facilitate the sliding nature of the cylindrical member 12 relative to the bushing 17, which allows for the cylindrical member 12 to selectively (based on user input) telescopically extend from and retract into the bushing 17 and/or the underground piping 94. According to some embodiments, the tabs 53 can be configured to slidingly engage the guide slots 44. The tabs 53, and/or ears thereof, can fit into the guide slots 44 according to some embodiments. According to some embodiments, the bushing has opposing tabs 53 that align with opposing guide slots 44 of the cylindrical member 12. This alignment facilitates easy and effective sliding of the cylindrical member 12 relative to the bushing 17. Additionally, each tab 53 is configured to be able to be inserted into a locking mechanism 46 of the cylindrical member 12. According to some embodiments, the bushing 17 has opposing tabs 53 that align with opposing locking mechanisms 46 of the cylindrical member 12. According to some embodiments, when viewing the tabs 53 from above, such as in FIG. 10, the diameter of the circular portion of each tab 53 can be 0.75 inches. However, the diameter of the circular portion of each tab 53 can be any suitable size.

Each flange 54 can be a protrusion, projection, and/or other similar structure that extends radially outwardly from the outer surface 57 of the bushing 17. Additionally, each flange 54 can extend along the length 62 of the bushing 17 as shown in FIGS. 9 and 11. The bushing 17 can be inserted into the exposed end of the underground piping 94. Also, the bushing 17 is removable from the underground piping 94. The flange(s) 54 are configured to provide for proper fitting of the bushing 17 and also to act as a stabilizer and/or buffer to stabilize the bushing 17 and prevent and/or mitigate any unwanted movement of the bushing 17 when the bushing 17 is inserted into the underground piping 94. According to some embodiments, the bushing 17 can be inserted into the underground piping 94 wherein the bushing 17 contacts the underground piping via the outer surface 57 and/or the flange(s) 54. The flange(s) 54 also provide spacing such that the rib 56 can rest on an outer edge of each flange 54 wherein space exists between the rib 56 and the outer surface 57 of the body 50 of the bushing 17 as shown in FIG. 9. While the example bushing of FIGS. 9-11 shows eight flanges 54, any number of flanges ranging from one to N where N is any number greater than one could be included. It should be noted that while the example bushing 17 shown in FIGS. 9-11 includes eight flanges 54, only some flanges are labeled in FIGS. 9-11 for the sake of clarity.

The bushing 17 can include a rib 56 as shown in FIG. 9. The rib 56 can extend radially around the outer surface 57 of the bushing 17 at and/or near one end of the bushing 17. For example, the embodiment of FIGS. 9-11 shows the rib 56 extending radially around the outer surface 57 of the bushing 17 at and/or near the first end 51 of the bushing 17. The rib 56 can be connected to the bushing 17 via an outer edge of each flange 54 such that space exists between the rib 56 and the outer surface 57 of the body 50. While not shown in the embodiment of FIGS. 9-11, according to some embodiments, screws and/or other attachment means can be used in conjunction with the rib 56 to facilitate secure attachment of the bushing 17 to the underground piping 94. For example, screw(s) can be inserted through the rib 56 and the underground piping 94 to create an effective attachment between the bushing 17 and the underground piping 94. Thus, according to some embodiments, the rib 56 can comprise one or more apertures for which screw(s) can be inserted.

The bushing 17 can include a rim 58. According to some embodiments, the rim 58 can be a generally flat, circular structure and can be positioned at and/or near one end of the bushing 17. For example, in the embodiment of FIGS. 9-11, the rim 58 is positioned at the first end 51 of the body 50 of the bushing 17. The rim 58 can be in contact with the rib 56 as is shown in FIG. 9. The rim 58 can extend radially outwardly from the body 50. When the bushing 17 is fully inserted into the underground piping 94, the rim 58 can be flush with and/or rest on the surface of the ground.

FIG. 10 shows a top plan view of the bushing 17. According to some embodiments, the total diameter 60 of the bushing 17, inclusive of the rim 58, can be 6.755 inches. However, the diameter 60 of the bushing 17 can be any suitable size. According to various embodiments, the diameter of the bushing 17, inclusive or exclusive of the rim 58, can be any suitable size. For example, according to various embodiments, the diameter of the bushing 17, inclusive or exclusive of the rim 58, could be 4, 6, 8, 10, or 12 inches.

FIG. 11 shows a side elevation view of the bushing 17. According to some embodiments, the total length 62 of the bushing 17 can be 4.5 inches. However, the length 62 of the bushing 17 can be any suitable length.

Figure 12:
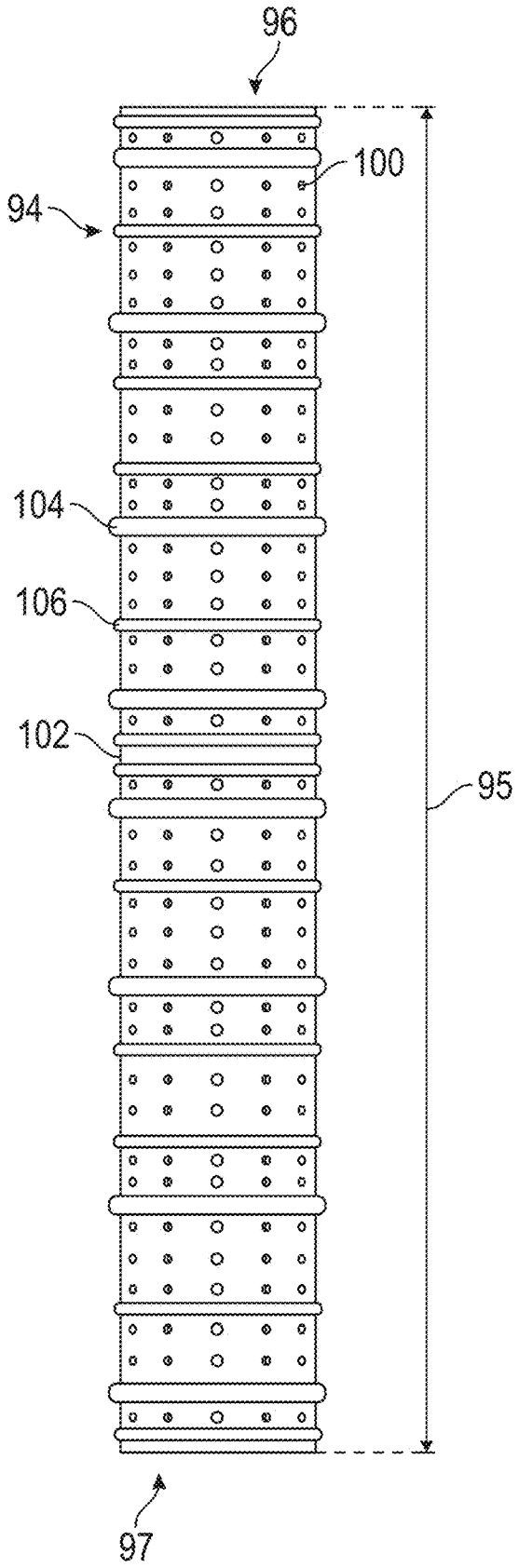
FIG. 12 shows a side elevation view of underground piping according to some aspects of the disclosure.
Figure 13:
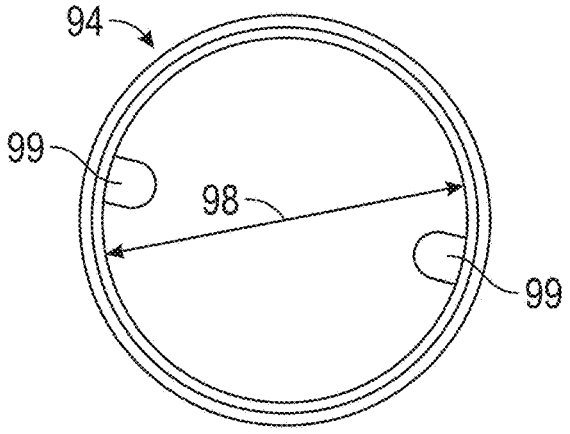
FIG. 13A shows a top plan view of the underground piping of FIG. 12.
FIG. 13B shows a perspective view generally of the top of underground piping according to some aspects of the disclosure.

FIGS. 12 and 13A show various views of underground piping 94 according to some embodiments. FIG. 12 shows a side elevation view of underground piping 94. As shown in FIG. 12, according to some embodiments, the underground piping 94 can comprise a top 96, a bottom 97, zero or more aperture(s) 100, zero or more large separator(s) 102, zero or more medium separator(s) 104, zero or more small separator(s) 106, and an outer wall 110.

The underground piping 94 can be made of any suitable material including, but not limited to, plastic, metal, and the like. As shown in FIGS. 12 and 13A, the underground piping 94 can be generally cylindrical and/or tube-like. According to some embodiments, the underground piping 94 can be positioned generally vertically in the ground in and/or near an agricultural field wherein the top 96 of the underground piping is level with, flush with, at, and/or near ground level such that the top 96 of the underground piping 94 is generally exposed to the outside air above ground. Additionally, the top 96 of the underground piping 94 can be open such that a cylindrical member 12 can slidingly engage the underground piping 94 wherein the cylindrical member 12 can be retracted into and extended from the underground piping 94 in a telescopic manner.

As shown in FIG. 12, the underground piping 94 can include a bottom 97. According to some embodiments, the bottom 97 can be open such that the underground piping 94 can be operatively connected to additional piping and/or other aspects of a drainage system that are positioned below ground in order to drain excess water and/or control erosion.

According to some embodiments, the underground piping 94 can include zero or more apertures 100. While the embodiment shown in FIG. 12 shows the underground piping 94 including many apertures 100, only one is labeled for the sake of clarity. According to some embodiments, the number of apertures 100 can range from zero to N where N is any number greater than zero. The apertures 100 can be generally circular in shape, as is shown in FIG. 12, but the apertures 100 could be any suitable shape according to various embodiments. The apertures 100 of the underground piping 94 can be smaller in diameter than the apertures 32 of the cylindrical member 12 according to some embodiments. The smaller diameter of the apertures 100 of the underground piping 94 allow for ground water to enter the underground piping 94 while keeping soil and debris out. Letting ground water into the underground piping 94 while keeping soil and other types of debris out allows the underground piping 94 to function properly to drain excess water and/or control erosion without being slowed and/or rendered less effective due to clogging, damage, and/or other issues caused by the buildup of soil and/or other debris.

As shown in FIG. 12, the underground piping 94 can be divided into sections that are divided by separators. Multiple types of separators can be used including large separator(s) 102, medium separator(s) 104, and small separator(s) 106. While FIG. 12 shows that the underground piping 94 includes several of each kind of separator 102, 104, 106, the underground piping 94 can include any number of separators 102, 104, 106 and sections. Only one of each type of separator is labeled in FIG. 12 for the sake of clarity. Dividing the underground piping 94 into sections via the use of separator(s) 102, 104, 106 can contribute to the structural integrity of the underground piping 94.

The underground piping 94 can be of any suitable length 95. For example, the underground piping could be 1 foot, 2 feet, 3 feet, 4 feet, and/or any other suitable length. The example underground piping 94 shown in FIG. 12 has a length 95 of 46 inches.

FIG. 13A shows a top plan view of the underground piping 94 of FIG. 12. The underground piping 94 of FIGS. 12 and 13A is an embodiment wherein the vibration isolator 14 is integrally formed as part of the underground piping 94. Thus, the embodiment of the underground piping 94 of FIGS. 12 and 13A does not require the use of a bushing 17. The vibration isolator 14 can include one or more tabs 99 integrally formed as part of the underground piping 94 on an inner wall 108 of the underground piping 94 such that the tab(s) 99 extend inwardly toward the center of the underground piping 94 as shown in FIG. 13A. For example, the embodiment of FIGS. 12 and 13A shows the vibration isolator 14 including two tabs 99. Just like the bushing 17 and tab(s) 53 thereof, the one or more tabs 99 are configured to align with and slidingly engage the guide slot(s) 44 of the cylindrical member 12 and/or align with and interact with the locking mechanism(s) 46 of the cylindrical member 12. Thus, the tab(s) 99 properly align the cylindrical member 12 and the underground piping 94. The tab(s) 99 of the integrally formed vibration isolator 14 are configured to function in the same and/or similar manner as the tab(s) 53 of the bushing 17 according to some embodiments. Additionally, the tab(s) 99 of the integrally formed vibration isolator 14 are configured to have the same and/or similar properties/characteristics/attributes as the tab(s) 53 of the bushing 17 according to some embodiments. Additionally, according to embodiments in which the vibration isolator 14 comprises tab(s) 99 integrally formed with the underground piping 94 rather than comprising a bushing 17, such tab(s) 99 can be positioned in generally the same or similar location relative to the top 96 of the underground piping 94 as the tab(s) 53 of the bushing 17 in embodiments wherein the vibration isolator 14 comprises a bushing 17. For example, according to some embodiments, the tab(s) 99 can be positioned on the inner wall 108 of the underground piping 94 six inches or less from the top 96 of the underground piping 94.

FIG. 13A also shows a diameter 98 of the underground piping 94. According to various embodiments, the diameter 98 can be any suitable length such that the cylindrical member 12 can slide into the underground piping 94. For example, according to some embodiments, the diameter 98 can be 6.45 inches. Additionally, the diameter 98 of the underground piping 94 could be 4, 6, 8, 10, or 12 inches according to various embodiments.

FIG. 13B shows a perspective view generally of the top 96 of underground piping 94 according to some embodiments. The underground piping 94 of FIG. 13B is shown above ground prior to below ground installation. The underground piping of FIG. 13B includes a vibration isolator 14 positioned on the inner wall 108 of the underground piping 94 wherein the vibration isolator 14 comprises two tabs 99 integrally formed with the underground piping 94. The example underground piping 94 of FIG. 13B is shorter in length than many embodiments of the underground piping 94. FIG. 13B is included as an example view of particular aspects of the underground piping 94.

All aspects of the underground piping 94 shown in FIG. 12 can be included in various embodiments thereof whether the vibration isolator 14 is a removable bushing 17 and/or is integrally formed with the underground piping 94.

Although not required, embodiments of the telescoping riser assembly 10 that are used in conjunction with already existing tile draining systems wherein the underground piping is already installed, can utilize a bushing 17 as the vibration isolator 14. Although not required, embodiments of the telescoping riser assembly 10 that are used in conjunction with new tile draining systems to be installed in an agricultural field, can utilize underground piping 94 wherein the vibration isolator 14 is and/or comprises one or more tab(s) 99 integrally formed with the underground piping 94. Thus, by installing underground piping 94 wherein the vibration isolator 14 is and/or comprises one or more tabs 99 integrally formed with the underground piping 94, the new tile drainage system to be installed can eliminate the need to utilize one or more bushings 17.

Figure 14:
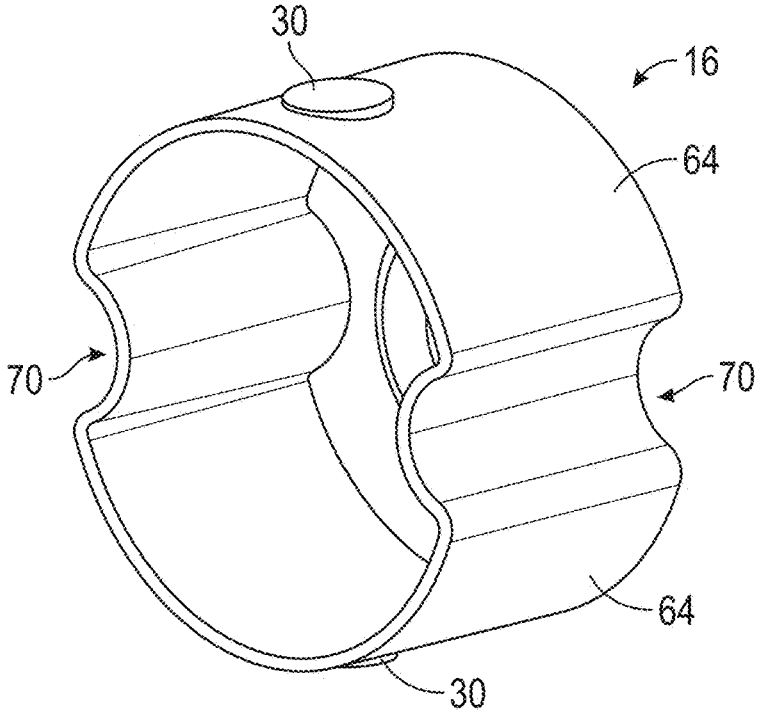
FIG. 14 shows a perspective view of a snap cap according to some aspects of the disclosure.

FIGS. 14-17 show various views of an example embodiment of a snap cap 16. The example embodiment of the snap cap 16 shown in FIGS. 14-17 could be used as the snap cap of the drain riser assembly 10 shown in FIGS. 1 and 2, according to some embodiments. FIG. 14 shows a perspective view of the example embodiment of a snap cap 16. According to the embodiment of FIGS. 14-17, the snap cap 16 can comprise side wall(s) 64, one or more slots 70, one or more protrusions 30, a top end 66, a bottom end 68, and an overmold 34.

As seen in FIGS. 14-17, the snap cap 16 can be generally cylindrical according to some embodiments and can have side walls 64 that are curved. The snap cap 16 is configured to be attachable to one end of the cylindrical member 12. According to some embodiments, attachment of the snap cap 16 to the cylindrical member 12 involves sliding the snap cap 16 onto an end of the cylindrical member 12. The slots 70 of the snap cap help facilitate such sliding. While the embodiment of FIGS. 14-17 shows two opposing slots 70, any number of slots 70 could be included. The opposing slots 70 of the embodiment of FIGS. 14-17 are configured to align with the back 48 of each opposing guide slot 44 of the cylindrical member 12. In this fashion, the snap cap 16 is configured to be slid onto an end of the cylindrical member 12 wherein the slots 70 of the snap cap 16 at least partially surround the back 48 of each guide slot 44 of the cylindrical member 12. Therefore, the guide slots 44, and the backs 48 thereof, of the cylindrical member 12 and the slots 70 of the snap cap 16 slidingly interact to facilitate sliding engagement between and attachment of the snap cap 16 and the cylindrical member 12.

The fact that the slots 70 of the snap cap 16 fit into the guide slots 44 of the cylindrical member 12, or vice versa, also serves to align the protrusion(s) 30 of the snap cap 16 with aperture(s) 32 of the cylindrical member 12. As noted above with reference to FIG. 3, the protrusion(s) 30 are each configured to fit into and/or snap into an aperture 32 of the cylindrical member 12 to secure the snap cap 16 to the cylindrical member 12. Each protrusion 30 can be generally circular and can extend outwardly from the side wall(s) 64 of the snap cap 16. A user can press fit the protrusion(s) 30 into aperture(s) 32 in order to secure and/or attach the snap cap 16 to the cylindrical member 12. A user can remove the protrusion(s) 30 from the aperture(s) 32 in order to unsecure the snap cap 16 from the cylindrical member 12 to remove the snap cap 16 from the cylindrical member 12. The embodiment of FIGS. 14-17 includes two opposing protrusions 30 positioned on opposite sides of the snap cap 16, however, any suitable number of protrusions 30 could be included in any suitable formation.

Figure 15:
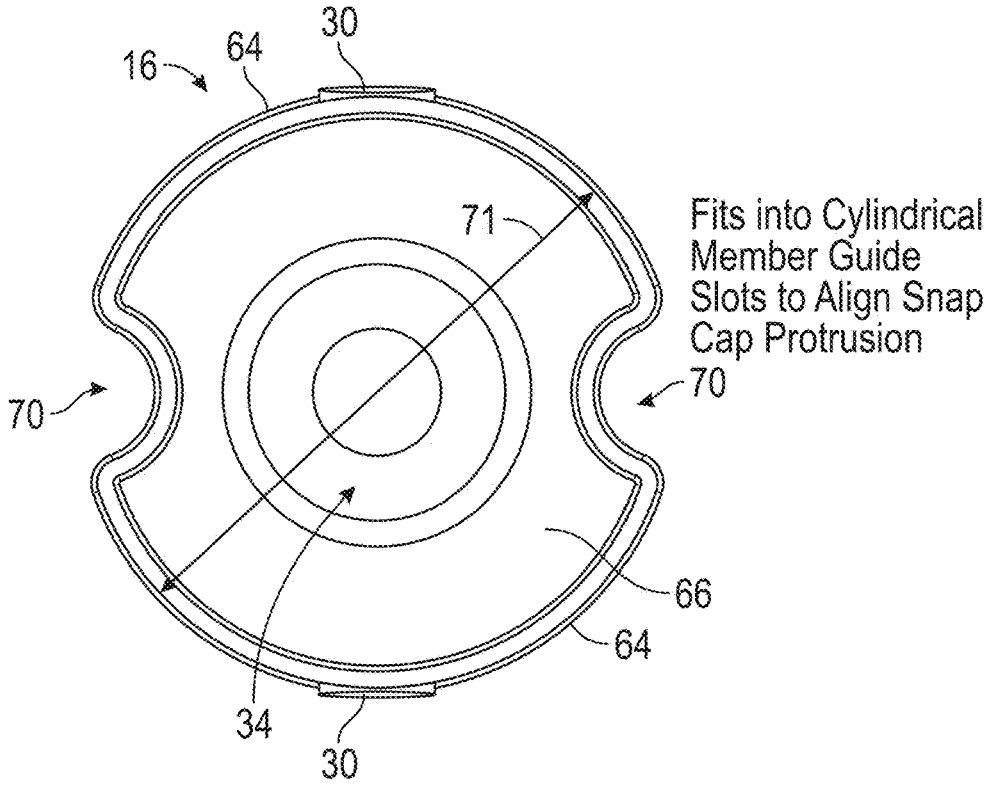
FIG. 15 shows a top plan view of the snap cap of FIG. 14.

FIG. 15 shows a top plan view of the snap cap 16. As shown in FIGS. 14 and 15, the top end 66 of the snap cap 16 is closed and the bottom end 68 is open such that the snap cap 16 forms a generally cylindrical shape having a closed top, side walls, and an open bottom. The top end 66 of the snap cap 16 can comprise an overmold 34 that extends upward from the top end 66. The overmold 34 can be generally circular in shape and can be positioned generally at or near the center of the top end 66 of the snap cap 16. According to some embodiments, the diameter 71 of the snap cap 16 from side wall 64 to side wall 64 can be 4.69 inches, however, the diameter 71 could be any suitable size. For example, according to various embodiments, the diameter 71 could be 4, 6, 8, 10, or 12 inches.

Figure 16:
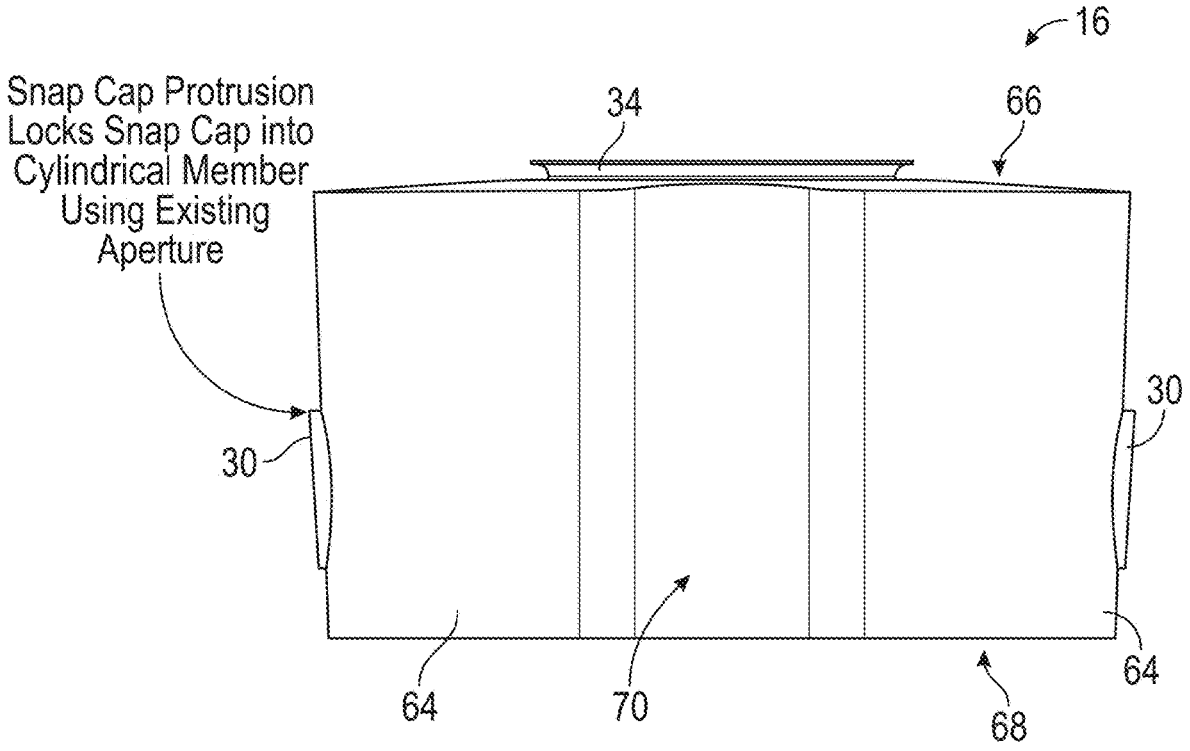
FIG. 16 shows a side elevation view of the snap cap of FIG. 14.
Figure 17:
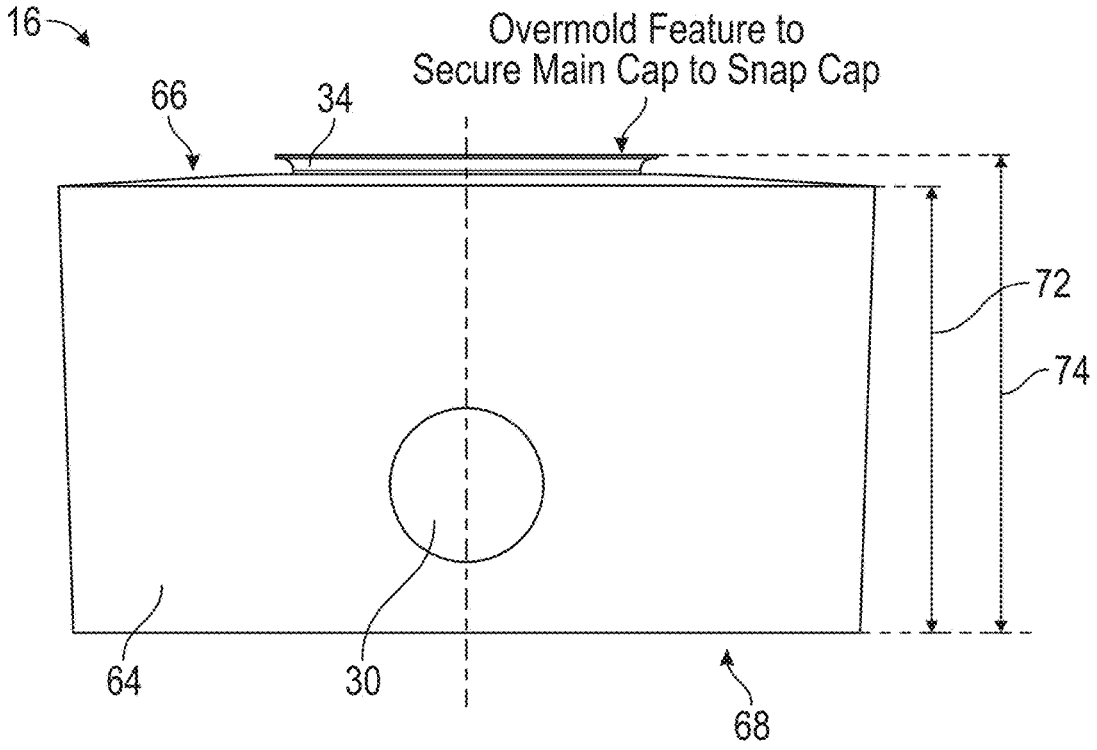
FIG. 17 shows a front elevation view of the snap cap of FIG. 14.

FIG. 16 shows a side elevation view of the snap cap 16 and FIG. 17 shows a front elevation view of the snap cap 16. As shown in FIGS. 16 and 17, the overmold 34 can be narrower where it contacts the top end 66 of the snap cap 16 and widen as it extends away from the top end 66. This variance in the width of the overmold 34 helps to facilitate attachment of the main cap 18 to the snap cap 16. According to some embodiments, the height 72 of the side walls 64 of the snap cap 16 can be 2.585 inches and the total height 74 of the snap cap 16, inclusive of the overmold 34, can be 2.745 inches. However, any suitable sizes can be used for the height 72 of the side walls 64 and/or the total height 74 of the snap cap 16.

Figure 18:
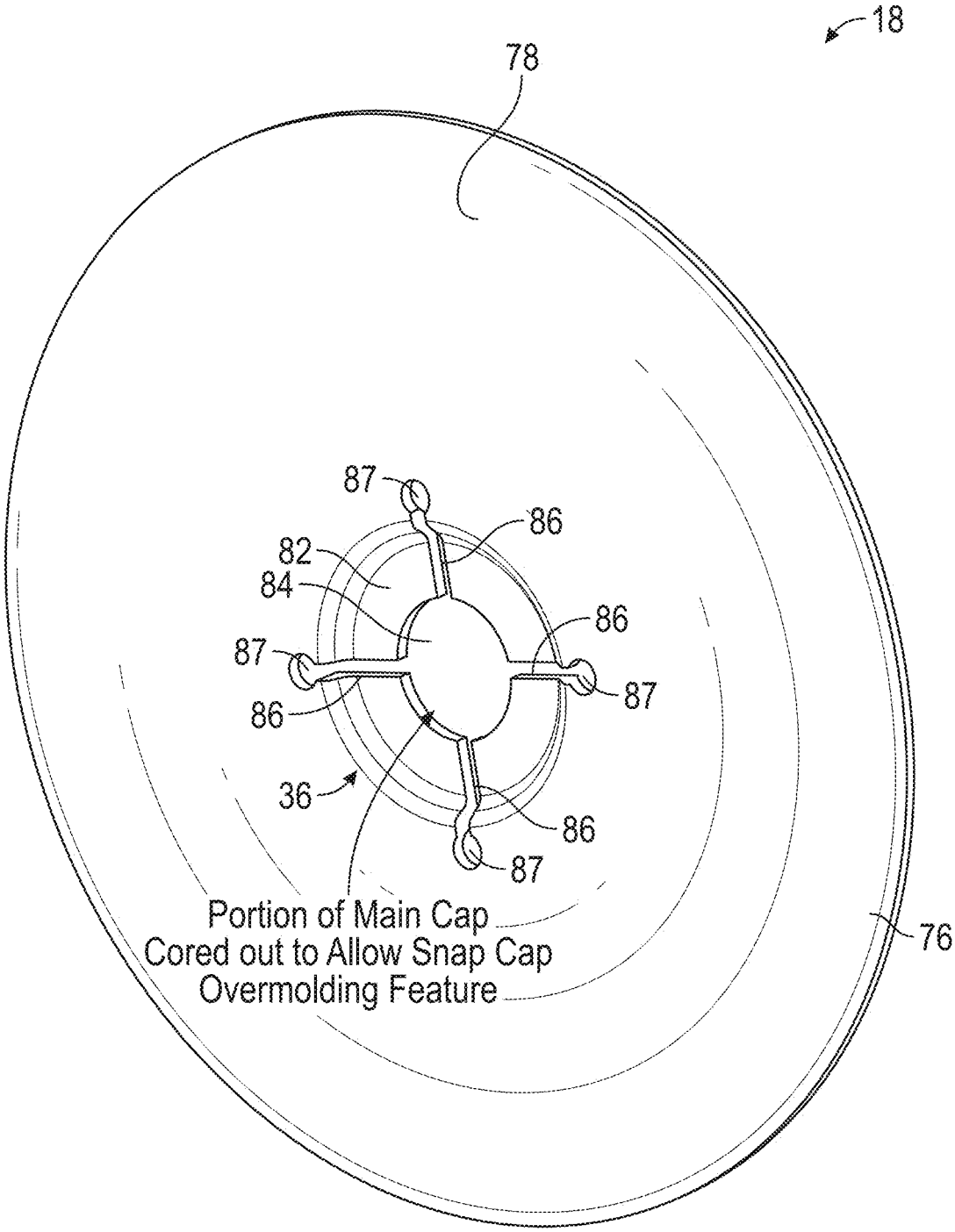
FIG. 18 shows a perspective view of a main cap according to some aspects of the disclosure.
Figure 19:
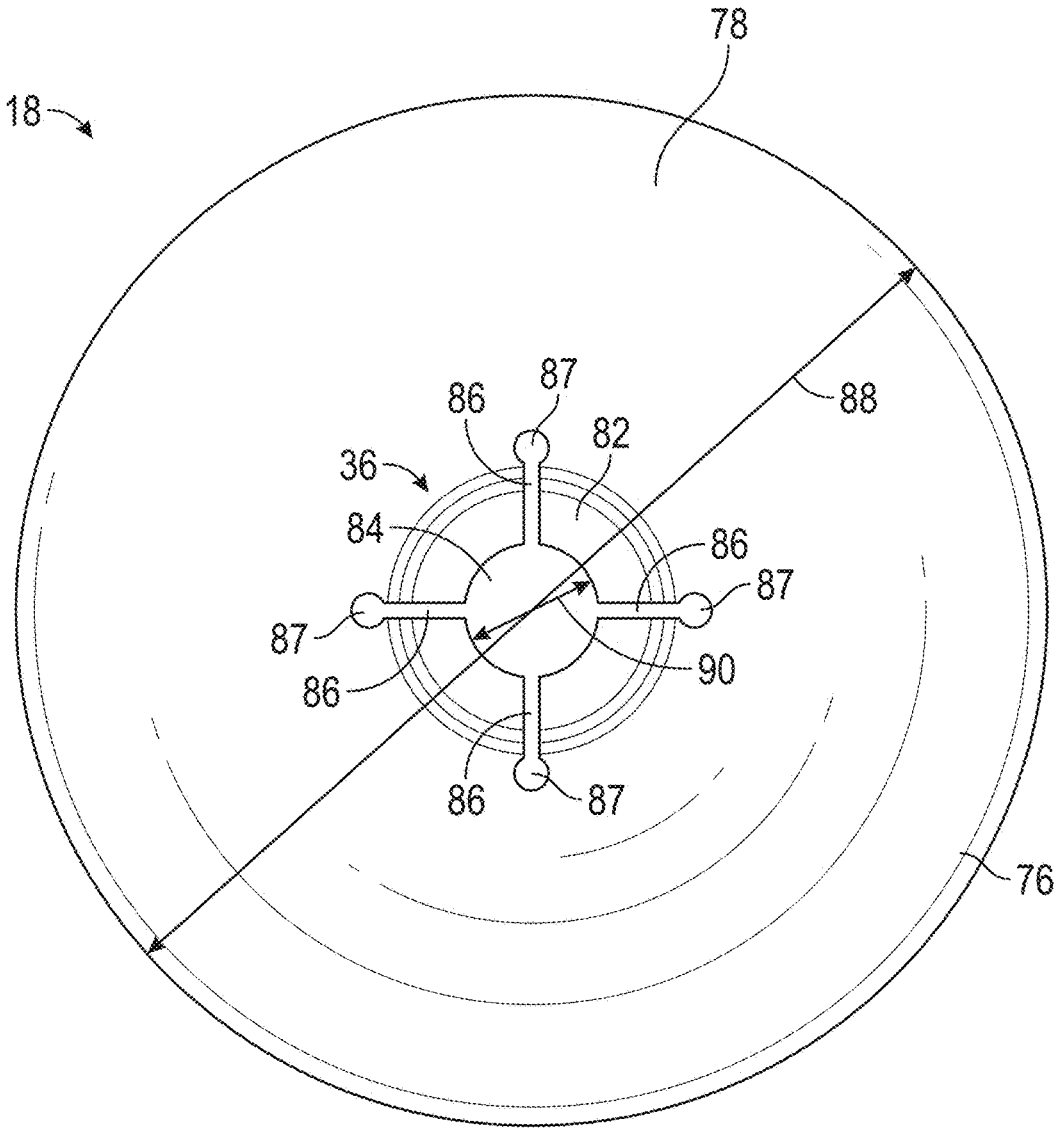
FIG. 19 shows a top plan view of the main cap of FIG. 18.
Figure 20:
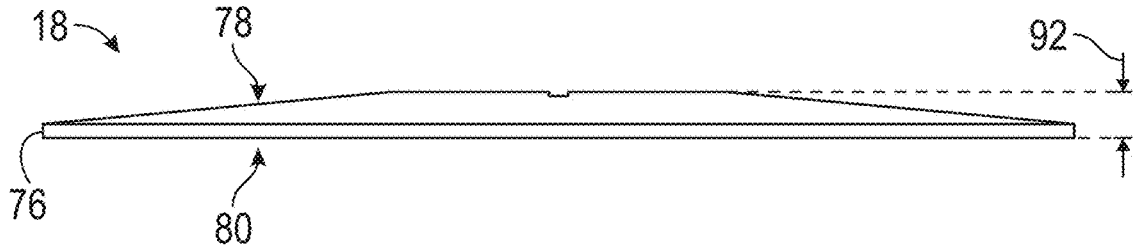
FIG. 20 shows a side elevation view of the main cap of FIG. 18.

FIGS. 18-20 show various views of the main cap 18. The example embodiment of the main cap 18 shown in FIGS. 18-20 could be used as the main cap of the drain riser assembly 10 shown in FIGS. 1 and 2, according to some embodiments. FIG. 18 shows a perspective view of the main cap 18. As shown in FIGS. 18-20, the main cap 18 can include a main cap body 76 (wherein the body 76 has a top 78 and a bottom 80) and a connection member 36 wherein the connection member 36 has a raised portion 82, a central portion 84, and one or more legs 86 wherein each leg has an end member 87.

The main cap 18 is configured to attach to the snap cap 16 wherein the overmold 34 of the snap cap 16 and the connection member 36 of the main cap 18 interact to facilitate the attachment. Thus, when the main cap 18 is attached to the snap cap 16 and the snap cap 16 is attached to the cylindrical member 12, the main cap 18 covers one of the ends of the cylindrical member 12.

As shown in FIGS. 18-20, the main cap body 76 is generally circular and can be disc-like according to some embodiments. According to various embodiments, the main cap body 76 can be made of and/or comprise plastic, metal (such as steel), polycarbonate, any other suitable material, and/or any combination thereof. The connection member 36 can be located generally in the center of main cap body 76 and extend upward from the top 78 of the main cap body 76. The connection member 36 can comprise a raised portion 82 and a plate 84. The raised portion 82 and/or plate 84 can be cored and/or hollowed out to allow space for the overmold 34 of the snap cap 16 such that the connection member 36 can matingly engage the overmold 34 to secure the main cap 18 to the snap cap 16. While FIGS. 18-20 show the plate 84 having four legs 86, according to some embodiments the plate 84 can have one or more legs 86 extending from it generally laterally and/or wherein each leg 86 can extend in a downward direction relative to the plate 84 toward the outward end of each leg 86. The end of each leg 86 can include an end member 87 that is generally circular in shape.

According to some embodiments, the diameter 88 of the body 76 of the main cap 18 can be 7.89 inches. However, the diameter 88 can be any suitable size. For example, according to various embodiments, the diameter 88 of the main cap 18 can be 4 inches, 6 inches, 8 inches, 10 inches, 12 inches, and/or any length greater than 12 inches. According to some embodiments, the diameter 90 of the plate 84 of the connection member 34 can be 1 inch. However, the diameter 90 can be any suitable size. According to some embodiments, the height 92 of the body 76 of the main cap 18 can be 0.245 inches. However, the height 92 could be any suitable size.

Figure 21:
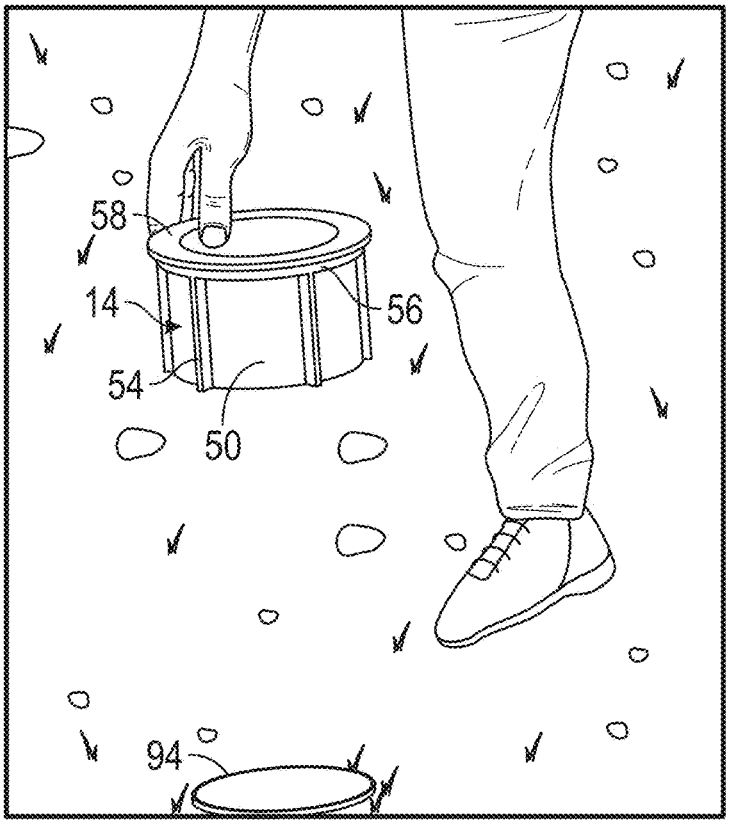
FIG. 21 shows a perspective view of a bushing and underground piping according to some aspects of the disclosure.
Figure 22:
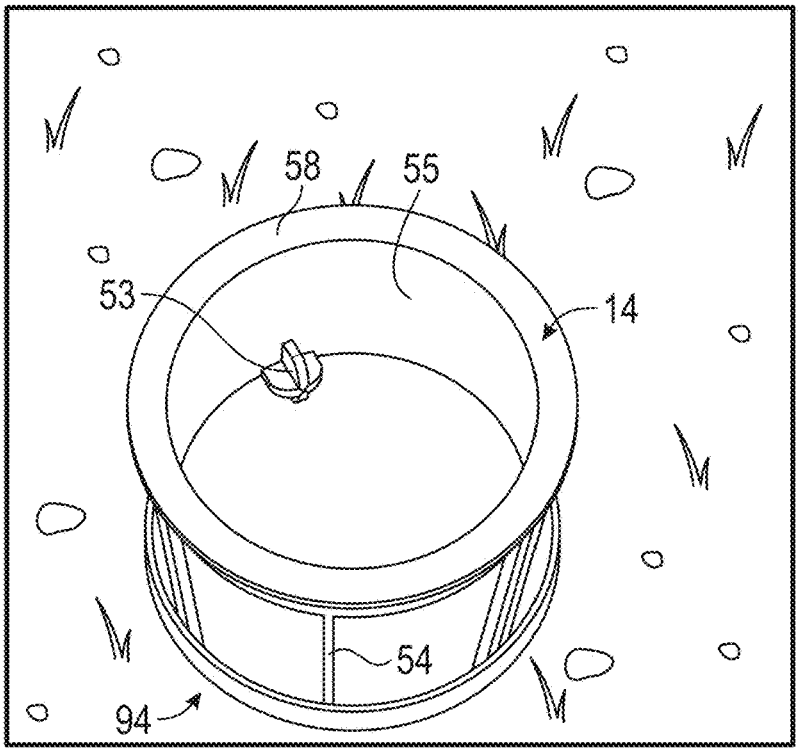
FIG. 22 shows a perspective view of the bushing of FIG. 21 partially inserted into the underground piping of FIG. 21.
Figure 23:
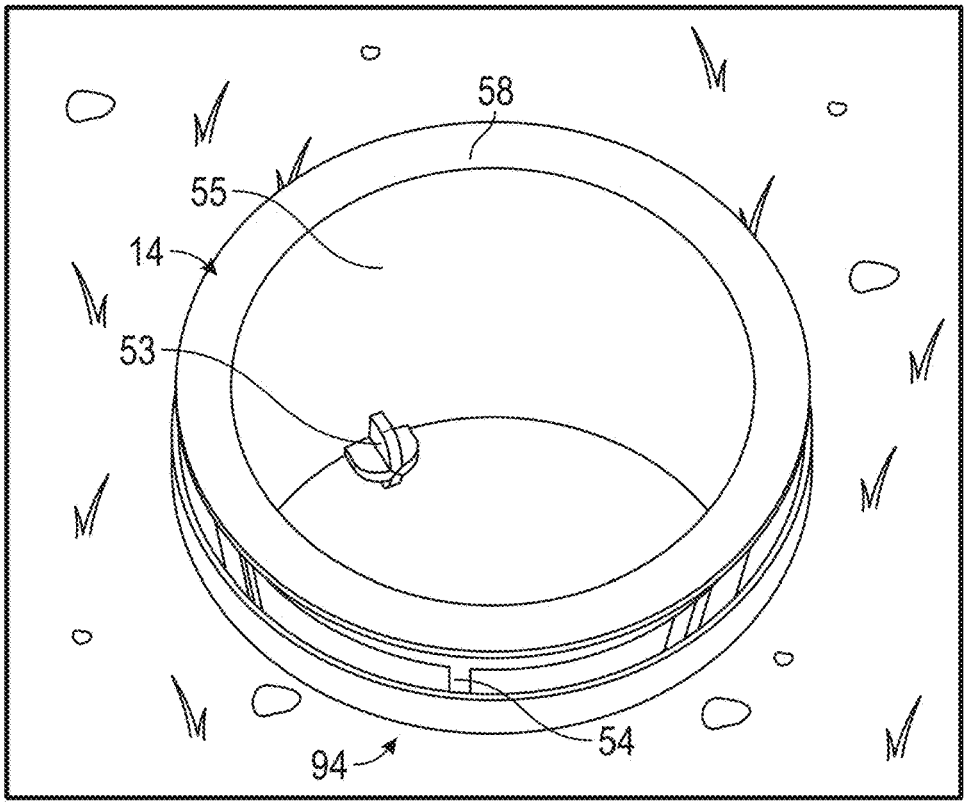
FIG. 23 shows a perspective view of the bushing of FIG. 21 partially inserted into the underground piping of FIG. 21.
Figure 24:
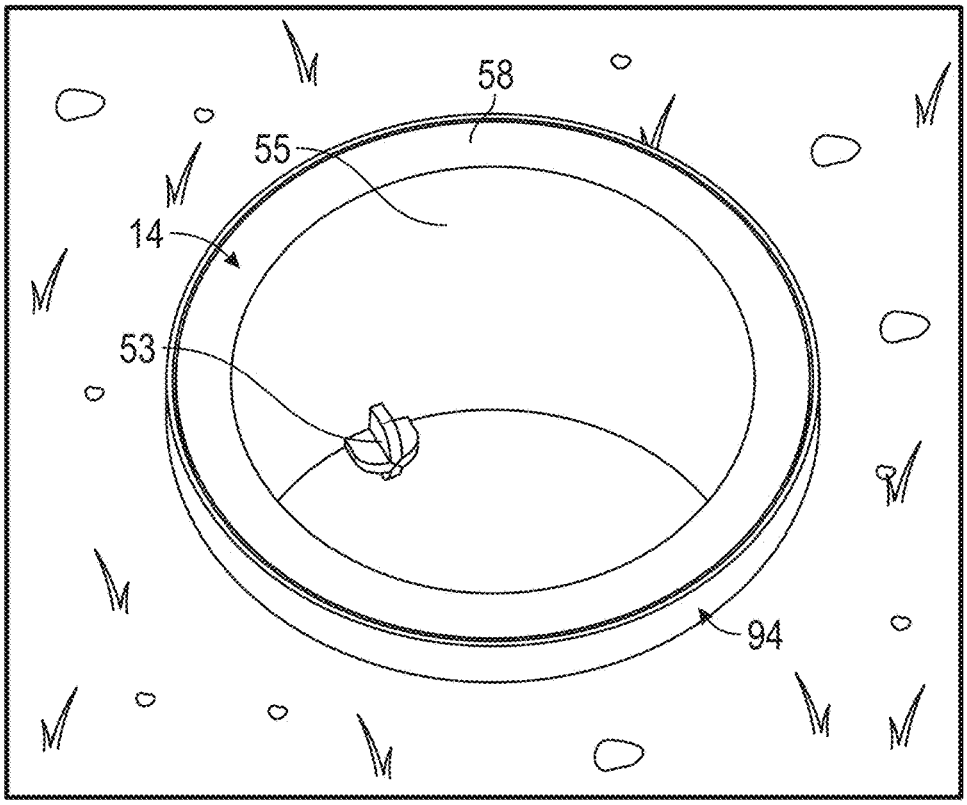
FIG. 24 shows a perspective view of the bushing of FIG. 21 fully inserted into the underground piping of FIG. 21.

FIGS. 21-24 show various views of a bushing 17 and underground piping 94. FIG. 21 shows a perspective view of the bushing 17 and underground piping 94 wherein the bushing 17 is not attached to the underground piping 94. FIGS. 22 and 23 show two different perspective views of the bushing 17 and underground piping 94 wherein the bushing 17 is partially inserted into the underground piping 94. FIG. 24 shows a perspective view of the bushing 17 and underground piping 94 wherein the bushing 17 is fully inserted into and attached to the underground piping 94.

FIGS. 21-24 show that the underground piping 94 includes an exposed open end that is positioned at or near the surface of the ground, wherein said exposed end is shown to be the top 96 of the underground piping 94 in FIG. 21. The progression of FIGS. 21-24 show how the bushing 17 can be inserted into and attached to the exposed open end of the underground piping 94. The flanges 54 of the bushing 17 can contact the inner wall 108 of the underground piping 94 to help secure and/or attach the bushing 17 to the underground piping 94. When the bushing 17 is fully inserted into and secured to the underground piping 94, the rim 58 of the bushing 17 is positioned at or near the surface of the ground.

Figure 25:
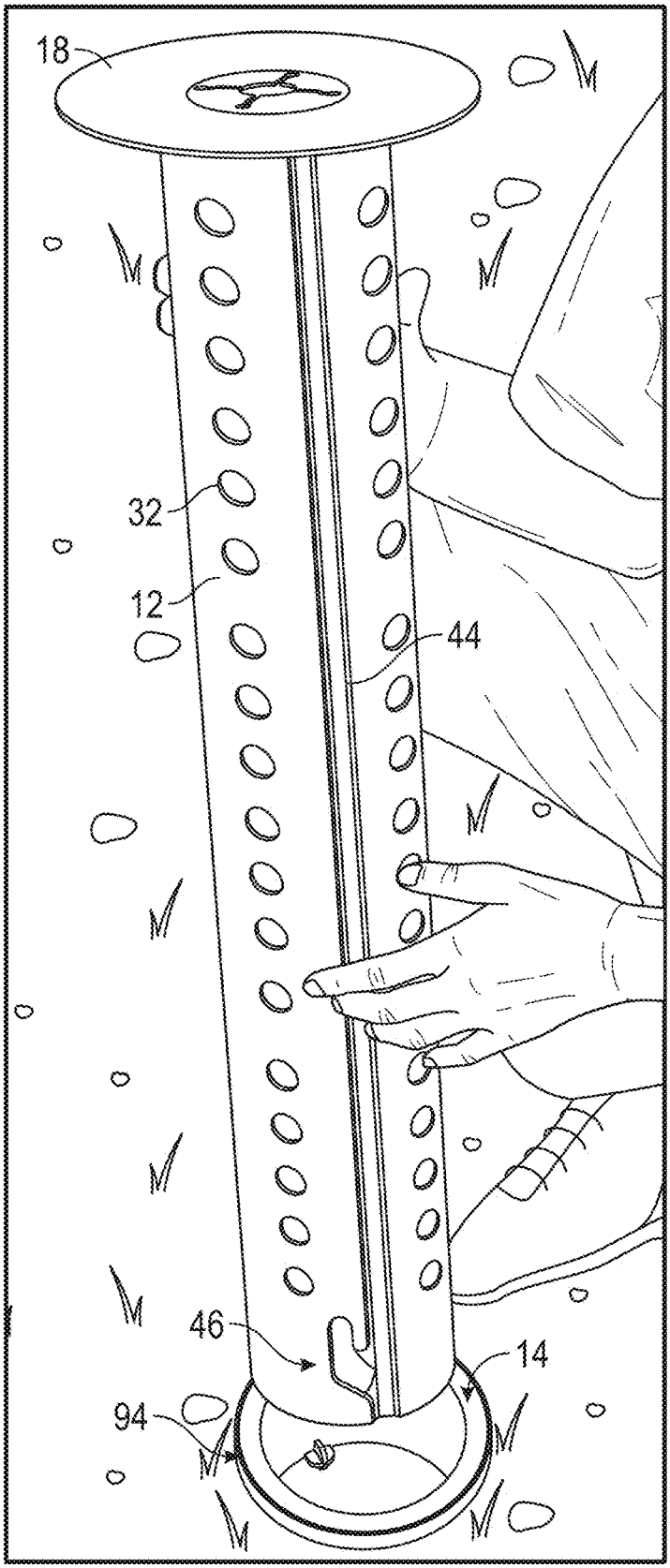
FIG. 25 shows a perspective view of aspects of an example telescoping riser assembly wherein a cylindrical member is removed from a bushing.

FIGS. 25-28 show various views of a cylindrical member 12, bushing 17, and underground piping 94, wherein a snap cap 16 and main cap 18 are attached to the cylindrical member 12. FIG. 25 shows a perspective view of a farmer preparing to insert the cylindrical member 12 into the bushing 17.

Figure 26:
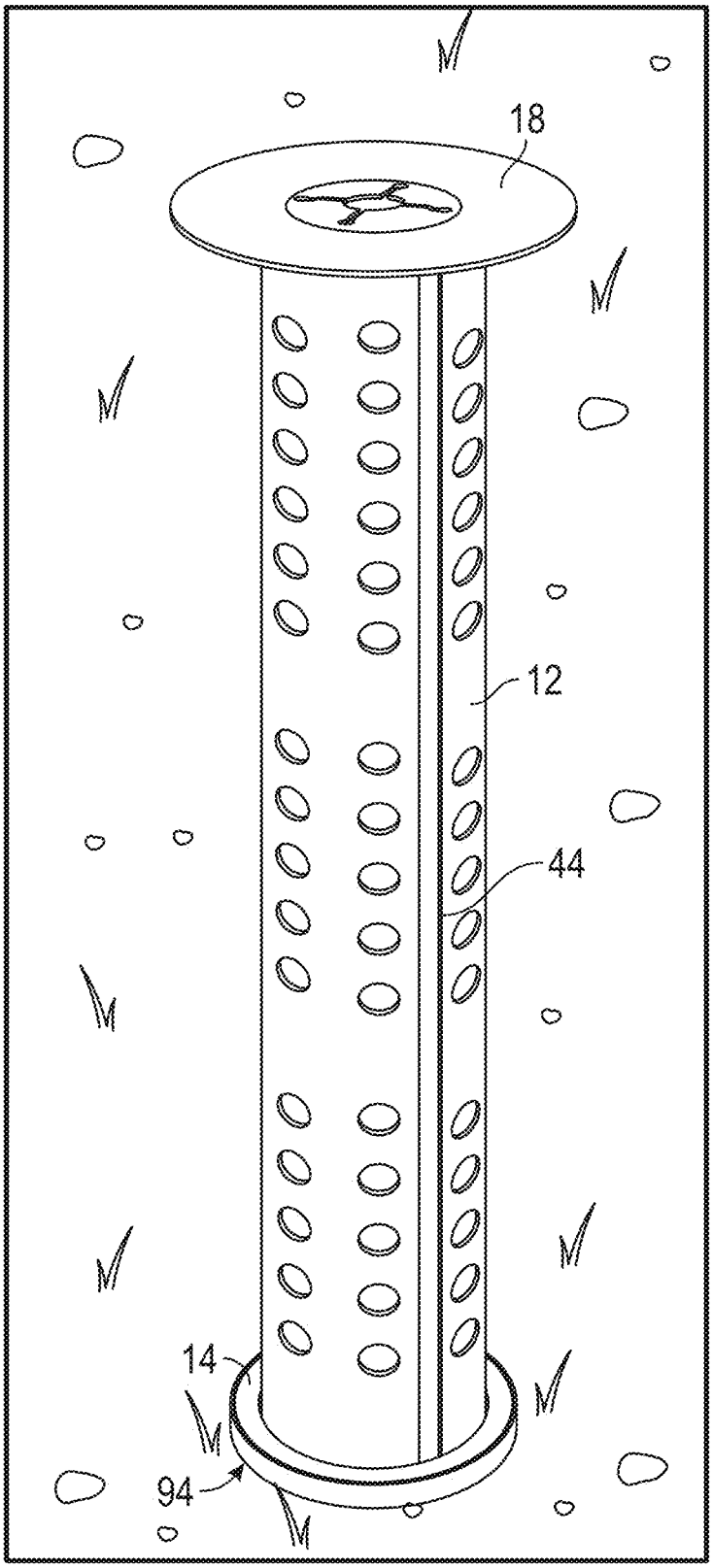
FIG. 26 shows a perspective view of aspects of the telescoping riser assembly of FIG. 25, wherein the cylindrical member is engaged with the bushing and is locked in the fully extended position.

FIG. 26 shows the cylindrical member inserted into the bushing 17 and locked in place relative to the bushing 17 and the underground piping 94 via the locking mechanism(s) 46 and/or tab(s) 53. The locked position of the cylindrical member 12 wherein the cylindrical member 12 extends above the surface of the ground as shown in FIG. 26 represents the "normal" position of the cylindrical member 12. In other words, whenever a farmer is not performing an agricultural activity (such as planting, harvesting, and the like) in the agricultural field, the locked and extended position of the cylindrical member 12 as shown in FIG. 26 is the position that the cylindrical member 12 will maintain.

Figure 27:
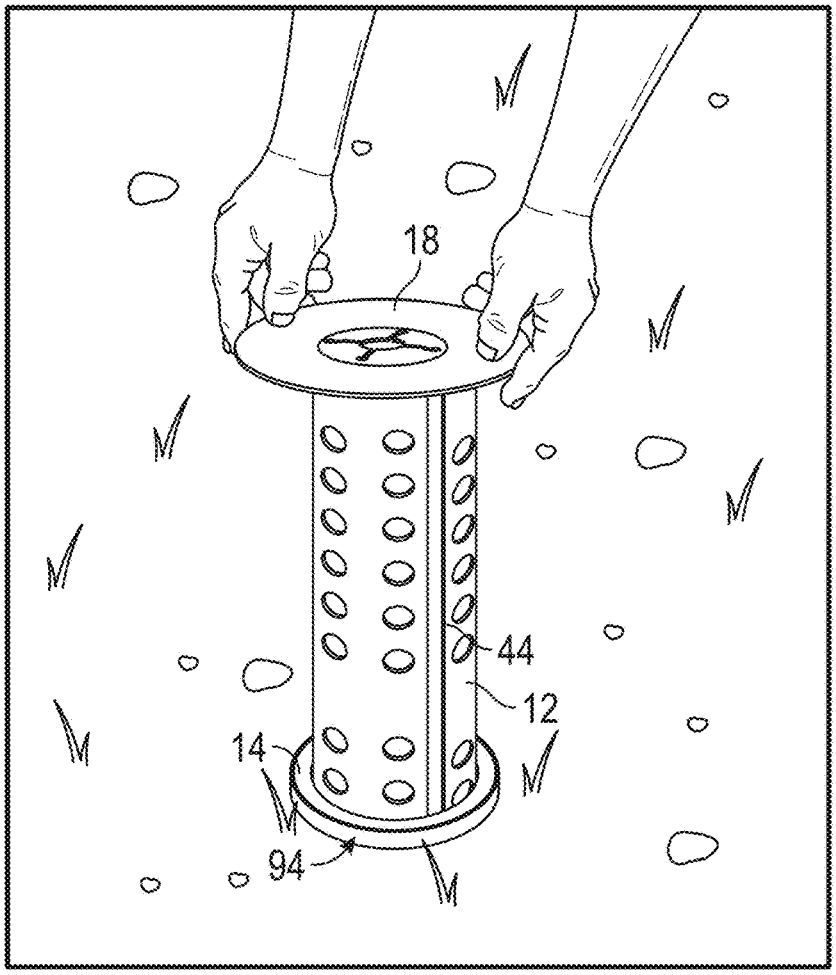
FIG. 27 shows a perspective view of aspects of the telescoping riser assembly of FIG. 25, wherein the cylindrical member is partially retracted into the bushing and underground piping.

FIG. 27 shows a perspective view of the cylindrical member 12 wherein the cylindrical member has been unlocked and has been partially retracted into the bushing 17 and the underground piping 94. As shown in FIG. 27, when the cylindrical member is partially retracted, more of its length is underground as compared to when the cylindrical member 12 is fully extended and in the locked position. According to some embodiments, the telescopic extension and retraction of the cylindrical member 12 can be accomplished via sliding the cylindrical member 12 relative to the bushing 17 wherein the tab(s) 53 of the bushing 17 are within the guide slot(s) 44 of the cylindrical member 12, which facilitates the sliding.

Figure 28:
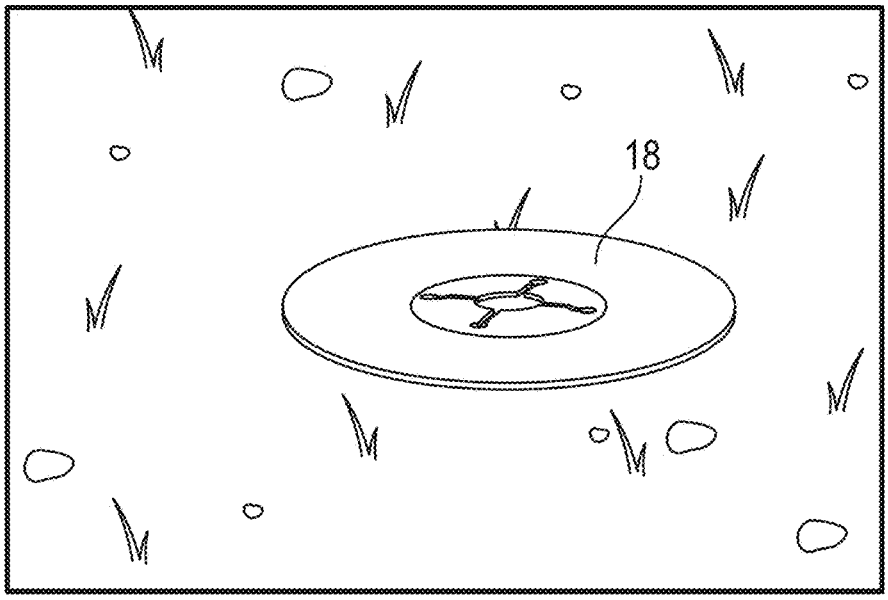
FIG. 28 shows a perspective view of aspects of the telescoping riser assembly of FIG. 25, wherein the cylindrical member is fully retracted into the bushing and underground piping.

FIG. 28 shows a perspective view when the cylindrical member 12 is fully retracted into the bushing 17 and underground piping 94. As shown in FIG. 28, when the cylindrical member 12 is fully retracted, the main cap 18 is flush with the ground and/or fits firmly to the ground. The fully retracted position of the cylindrical member 12 shown in FIG. 28 is used when a farmer is performing an agricultural activity such as planting, harvesting, and the like. By retracting the cylindrical member 12 into the bushing 17 and underground piping 94 such that the cylindrical member 12 is underground and the main cap 18 is flush with the surface of the ground and/or fits firmly to the surface of the ground, a farmer can perform the agricultural activity in the field without needing to waste time, money, effort, and resources to navigate around each drain riser assembly 10. A farmer can simply pass right over the main cap 18 when performing an agricultural activity. Additionally, since the main cap 18 is flush with the surface of the ground and/or fits firmly to the surface of the ground when the cylindrical member 12 is retracted, the main cap protects the drain riser assembly 10, including the underground piping 94, from being damaged. Also, since the main cap 18 is flush with the surface of the ground and/or fits firmly to the surface of the ground when the cylindrical member 12 is retracted, the main cap 18 prevents debris from entering the drain riser assembly 10, including the bushing 17 and/or the underground piping 94. The main cap 18 acts as a shield in this way to protect the drain riser assembly 10 from damage and/or debris.

It should be noted that while FIGS. 21-28 include the use of a bushing 17 as the vibration isolator 14, tab(s) 99 integrally formed with the underground piping 94 could be used as the vibration isolator 14 instead of the bushing 17 according to various embodiments.

Figure 29:
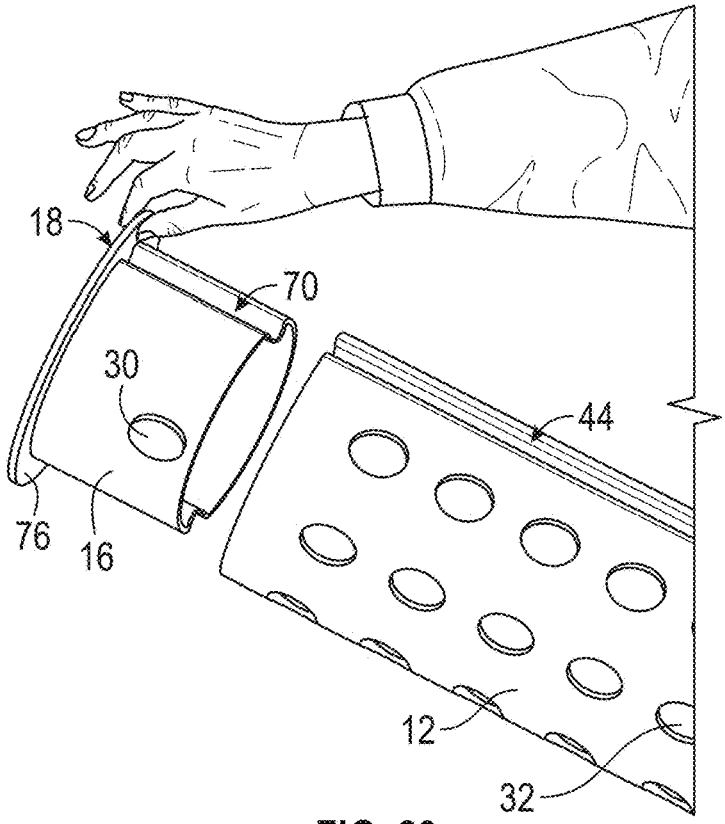
FIG. 29 shows a perspective view of aspects of an example drain riser assembly wherein the snap cap and main cap are not attached to the cylindrical member.
Figure 30:
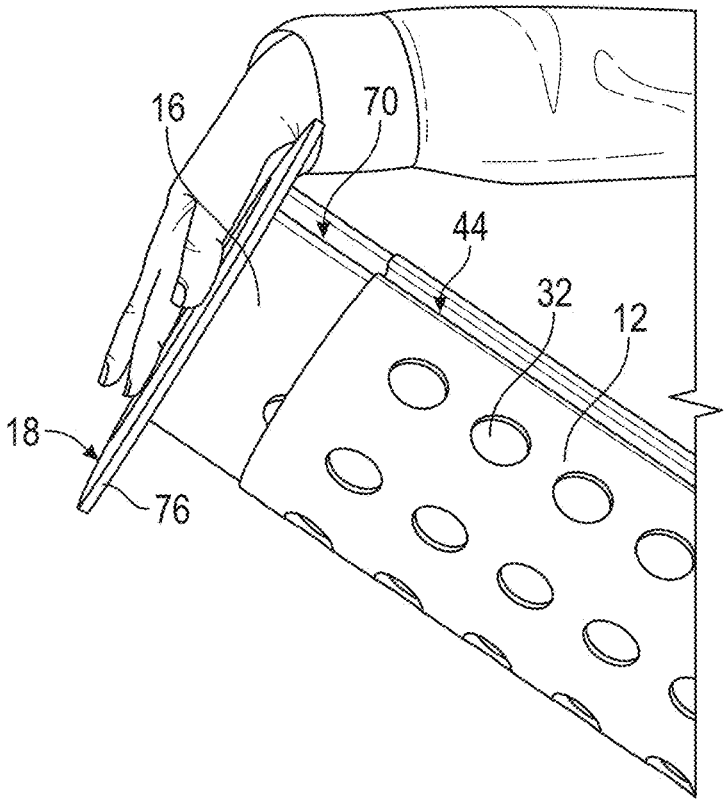
FIG. 30 shows a perspective view of aspects of the drain riser assembly of FIG. 29 wherein the snap cap and main cap are partially attached to the cylindrical member.
Figure 31:
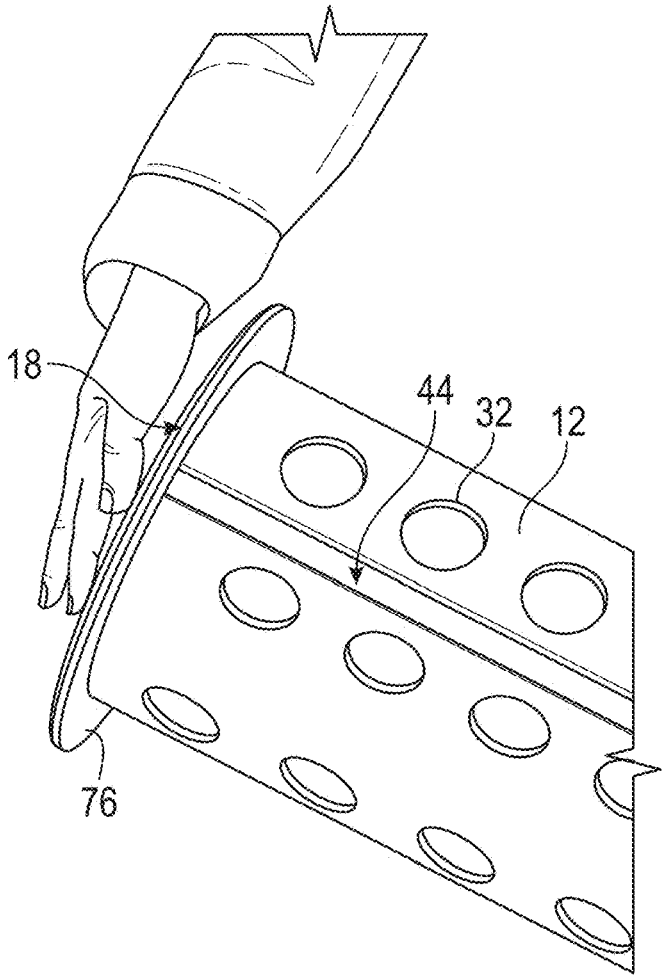
FIG. 31 shows a perspective view of aspects of the drain riser assembly of FIG. 29 wherein the snap cap and main cap are fully attached to the cylindrical member.

FIGS. 29-31 show various views of a cylindrical member 12, snap cap 16, and main cap 18. FIG. 29 shows a perspective view of a farmer preparing to attach the snap cap 16, and main cap 18, to the cylindrical member 12. FIG. 30 shows a perspective view of the snap cap 16, and main cap 18, in the process of slidingly being attached to the cylindrical body 12. FIG. 31 shows a perspective view of the snap cap 16, and main cap 18, fully attached to the cylindrical body 12. As shown in FIG. 31, the body 76 of the main cap 18 rests at or near and/or is in contact with an end of the cylindrical member 12 when fully attached.

It is noted that any component(s) shown and/or described in FIGS. 21-31 could be included as part of the drain riser assembly 10 of FIGS. 1 and 2, according to some embodiments.

It is noted that each component of the drain riser assembly 10 can be made of and/or comprise plastic, metal (such as steel), polycarbonate, any other suitable material, and/or any combination thereof. Additionally, each component of the drain riser assembly 10 is configured to be resistant to ultra-violet (UV) rays including, but not limited to, being resistant to both UVA and UVB rays.

Figure 32:
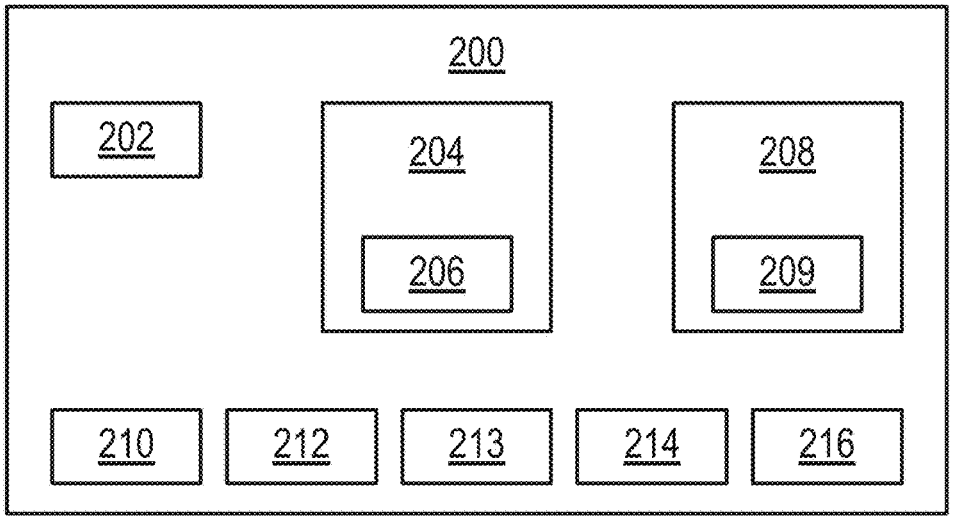
FIG. 32 shows a block diagram of a telescoping riser system according to some aspects of the disclosure.

FIG. 32 shows a block diagram of a telescoping riser system 200. According to some embodiments, the system 200 can comprise one or more telescoping riser assemblies 202, a human-machine interface ("HMI") 204 (wherein the HMI 204 can comprise a user interface ("UI") 206), a positioning system 208 (wherein the positioning system 208 can comprise one or more electronic locators 209), a controller/processing system 210, component(s) 212 for communication, a network 213, a memory 214, and a database 216.

The system 200 can be used to control and/or monitor one or more telescoping riser assemblies 202 in a portion of an agricultural field, in the entirety of an agricultural field, and/or across more than one agricultural field. The system 200 allows for a user to determine and/or monitor the position/location of each of the one or more telescoping riser assemblies 202 such that a user can pinpoint the exact location of each telescoping riser assembly that is part of the system 200. By allowing a user to determine the exact location of each telescoping riser assembly that is part of the system 200, a user can quickly, easily, and effectively extend and/or retract the top riser/cylindrical member at different times throughout the agricultural cycle.

The one or more telescoping riser assemblies 202 can comprise any number of telescoping riser assemblies ranging from one to N where N is any number greater than one. According to some embodiments, each of the one or more telescoping riser assemblies 202 can be the drain riser assembly/telescoping riser assembly 10 described herein.

The HMI 204 can be any suitable device capable of outputting information and/or communicating with other electronic and/or mechanical component(s). Examples of devices that could be used as the HMI 204 include, but are not limited to, a computer, a laptop, a tablet, a smartphone, a mobile device, a handheld device, and/or any other type of computing device or smart device. The HMI 204 can be operationally connected to each of the one or more telescoping riser assemblies 202.

According to some embodiments, the HMI 204 can include a user interface ("UI") 206. A UI is how the user interacts with a machine. The UI 206 can be a digital interface, a command-line interface, a graphical user interface ("GUI"), oral interface, virtual reality interface, or any other way a user can interact with a machine (user-machine interface). For example, the UI 206 can include a combination of digital and analog input and/or output devices or any other type of UI input/output device required to achieve a desired level of control and/or monitoring of aspect(s) of the system 200. Nonlimiting examples of input and/or output devices include computer mice, keyboards, touchscreens, knobs, dials, switches, buttons, speakers, microphones, printers, LIDAR, RADAR, etc. Input(s) received by the UI 206 can then be sent to the controller 210, a microcontroller, and/or any other controller to control operational aspect(s) and/or monitor aspect(s) of the system 200.

The UI 206 can include a display, which can act as an input and/or output device. More particularly, the display can be a liquid crystal display ("LCD"), a light-emitting diode ("LED") display, an organic LED ("OLED") display, an electroluminescent display ("ELD"), a surface-conduction electron emitter display ("SED"), a field-emission display ("FED"), a thin-film transistor ("TFT") LCD, a bistable cholesteric reflective display (i.e., e-paper), a touch-screen display, etc. The UI 206 also can be configured with a microcontroller and/or the controller 210 to display conditions or data associated with the system 200 in real-time or substantially real-time.

The system 200 can comprise a positioning system 208. The positioning system 208 could also be called a location determining system. The positioning system 208 can be used to determine and/or monitor the location of each of the one or more telescoping riser assemblies 202. The positioning system 208 could utilize the global positioning system ("GPS") and/or any other suitable positioning/location determination system. According to some embodiments, the positioning system 208 can comprise one or more electronic locator(s) 209 wherein one electronic locator 209 is operationally attached to each of the one or more telescoping riser assemblies 202. The positioning system 208 can utilize GPS, and/or any other similar location determining system, in conjunction with the one or more electronic locators 209 to pinpoint, determine, and/or monitor the location of each of the one or more telescoping riser assemblies 202. Each of the one or more electronic locators 209 can be battery-powered according to some embodiments. The positioning system 208 can be operationally connected to each of the one or more telescoping riser assemblies 202 and/or to the HMI 204.

With respect to the battery and/or batteries used to power the one or more electronic locators 209, a dry cell battery may be used. Additionally, the battery may be rechargeable, such as a lead-acid battery, a low self-discharge nickel metal hydride battery ("LSD-NiMH"), a nickel-cadmium battery ("NiCd"), a lithium-ion battery, or a lithium-ion polymer ("LiPo") battery. Careful attention should be taken if using a lithium-ion battery or a LiPo battery to avoid the risk of unexpected ignition from the heat generated by the battery. While such incidents are rare, they can be minimized via appropriate design, installation, procedures, and layers of safeguards such that the risk is acceptable.

As mentioned, according to some embodiments, a satellite-based radio-navigation system such as GPS is used. GPS uses satellites to provide geolocation information to a GPS receiver. GPS, and other satellite-based radio-navigation systems, can be used for location positioning, navigation, tracking, and mapping.

The system 200 can include an intelligent control/controller 210. Examples of such a controller may be processing units alone or other subcomponents of computing devices. The controller 210 can also include other components and can be implemented partially or entirely on a semiconductor (e.g., a field-programmable gate array ("FPGA")) chip, such as a chip developed through a register transfer level ("RTL") design process. According to some embodiments, the controller 210 can be part of the HMI 204. According to some embodiments, the controller 210 is separate from the HMI 204.

A processing unit, also called a processor, is an electronic circuit which performs operations on some external data source, usually memory or some other data stream. Nonlimiting examples of processors include a microprocessor, a microcontroller, an arithmetic logic unit ("ALU"), and most notably, a central processing unit ("CPU"). A CPU, also called a central processor or main processor, is the electronic circuitry within a computer that carries out the instructions of a computer program by performing the basic arithmetic, logic, controlling, and input/output ("I/O") operations specified by the instructions. Processing units are common in tablets, telephones, handheld devices, laptops, user displays, smart devices (TV, speaker, watch, etc.), and other computing devices.

The system 200 can further include component(s) 212 for establishing communications. Data and/or electronic communication can occur between any component(s) of the system 200 including the positioning system 208 which can include use of a GPS system (and/or similar location determining system), the one or more electronic locator(s) 209 operationally attached to each of the one or more telescoping riser assemblies 202, the HMI 204, the controller 210, the memory 214, and/or the database 216. According to some embodiments, such data and/or electronic communication can occur via the network 213. The component(s) 212 for establishing communications can include any combination of modem(s), router(s), access point(s), bridge(s), gateway(s), hub(s), repeater(s), switch(es), transceiver(s), and the like in order to facilitate data and/or electronic communication. The communications component(s) 212 can be configured to perform data communication wirelessly and/or in a wired fashion. According to some embodiments, the communications component(s) can include one or more communications ports such as Ethernet, serial advanced technology attachment ("SATA"), universal serial bus ("USB"), or integrated drive electronics ("IDE"), for transferring, sending, receiving, and/or or storing data.

According to some embodiments, the communications component(s) 212 are able to perform data communication either within the system 200 and/or externally of the system 200 in a wireless fashion using any sort of wireless connection device and/or protocol. This can include, but is not limited to, Bluetooth, Wi-Fi, cellular data, radio waves, satellite, and/or generally any other form of wireless connection. Therefore, the communications component(s) 212 will include generally any electronic component(s) necessary to allow for such wireless communication.

According to some embodiments, the communications component(s) 212 are able to perform data and/or electronic communication either within the system 200 and/or externally of the system 200 via a wired connection. Wired communication can take the form of CAN bus, Ethernet, co-axial cable, fiber optic line, and/or can include generally any other device and/or protocol which will allow for wired communication. Therefore, the communications component(s) 212 will include generally any electronic component(s) necessary to allow for such wired communication.

Ethernet is a family of computer networking technologies commonly used in local area networks ("LAN"), metropolitan area networks ("MAN") and wide area networks ("WAN"). Systems communicating over Ethernet divide a stream of data into shorter pieces called frames. Each frame contains source and destination addresses, and error-checking data so that damaged frames can be detected and discarded; most often, higher-layer protocols trigger retransmission of lost frames. As per the OSI model, Ethernet provides services up to and including the data link layer. Ethernet was first standardized under the Institute of Electrical and Electronics Engineers ("IEEE") 802.3 working group/collection of IEEE standards produced by the working group defining the physical layer and data link layer's media access control ("MAC") of wired Ethernet. Ethernet has since been refined to support higher bit rates, a greater number of nodes, and longer link distances, but retains much backward compatibility. Ethernet has industrial application and interworks well with Wi-Fi. The Internet Protocol ("IP") is commonly carried over Ethernet and so it is considered one of the key technologies that make up the Internet.

According to some embodiments, data and/or electronic communication can occur over the network 213. According to some embodiments, the network 213 is, by way of example only, a wide area network ("WAN") such as a TCP/IP based network or a cellular network, a local area network ("LAN"), a neighborhood area network ("NAN"), a home area network ("HAN"), or a personal area network ("PAN") employing any of a variety of communication protocols, such as Wi-Fi, Bluetooth, ZigBee, near field communication ("NFC"), etc., although other types of networks are possible and are contemplated herein. The network 213 typically allows communication between aspect(s) of the system 200 during moments of low-quality connections. Communications through the network 213 can be protected using one or more encryption techniques, such as those techniques provided by the Advanced Encryption Standard (AES), which superseded the Data Encryption Standard (DES), the IEEE 802.1 standard for port-based network security, pre-shared key, Extensible Authentication Protocol ("EAP"), Wired Equivalent Privacy ("WEP"), Temporal Key Integrity Protocol ("TKIP"), Wi-Fi Protected Access ("WPA"), and the like.

The Internet Protocol ("IP") is the principal communications protocol in the Internet protocol suite for relaying datagrams across network boundaries. Its routing function enables internetworking, and essentially establishes the Internet. IP has the task of delivering packets from the source host to the destination host solely based on the IP addresses in the packet headers. For this purpose, IP defines packet structures that encapsulate the data to be delivered. It also defines addressing methods that are used to label the datagram with source and destination information.

The Transmission Control Protocol ("TCP") is one of the main protocols of the Internet protocol suite. It originated in the initial network implementation in which it complemented the IP. Therefore, the entire suite is commonly referred to as TCP/IP. TCP provides reliable, ordered, and error-checked delivery of a stream of octets (bytes) between applications running on hosts communicating via an IP network. Major internet applications such as the World Wide Web, email, remote administration, and file transfer rely on TCP, which is part of the Transport Layer of the TCP/IP suite.

Transport Layer Security, and its predecessor Secure Sockets Layer ("SSL/TLS"), often runs on top of TCP. SSL/TLS are cryptographic protocols designed to provide communications security over a computer network. Several versions of the protocols find widespread use in applications such as web browsing, email, instant messaging, and voice over IP ("VoIP"). Websites can use TLS to secure all communications between their servers and web browsers.

The system 200 can further include a memory 214. The controller 210 can interact with the memory 214 in order to perform operations such as determining and/or monitoring the location of the one or more telescoping riser assemblies 202 via the one or more electronic locators 209. The memory 214 includes, in some embodiments, a program storage area and/or data storage area. The memory 214 can comprise read-only memory ("ROM", an example of non-volatile memory, meaning it does not lose data when it is not connected to a power source) or random access memory ("RAM", an example of volatile memory, meaning it will lose its data when not connected to a power source). Nonlimiting examples of volatile memory include static RAM ("SRAM"), dynamic RAM ("DRAM"), synchronous DRAM ("SDRAM"), etc. Examples of non-volatile memory include electrically erasable programmable read only memory ("EEPROM"), flash memory, hard disks, SD cards, etc. In some embodiments, the controller 110 or other processing unit, such as a processor, a microprocessor, or a microcontroller, is connected to the memory 214 and executes software instructions that are capable of being stored in a RAM of the memory 214 (e.g., during execution), a ROM of the memory 214 (e.g., on a generally permanent basis), or another non-transitory computer readable medium such as another memory or a disc. The memory 214 can be used to store information such as the location(s) of each of the one or more telescoping riser assemblies 202.

According to some embodiments, the system 200 can include a database 216. A database is a structured set of data typically held in a computer. The database 216, as well as data and information contained therein, need not reside in a single physical or electronic location. For example, the database 216 may reside, at least in part, on a local storage device, in an external hard drive, on a database server connected to a network such as the network 213, on a cloud-based storage system, in a distributed ledger (such as those commonly used with blockchain technology), or the like. The database 216 can be used to store information such as the location(s) of each of the one or more telescoping riser assemblies 202.

It should be noted that each component described herein to be part of the system 200 can be operationally connected such that each component is able to communicate with the other components.

Figure 33:
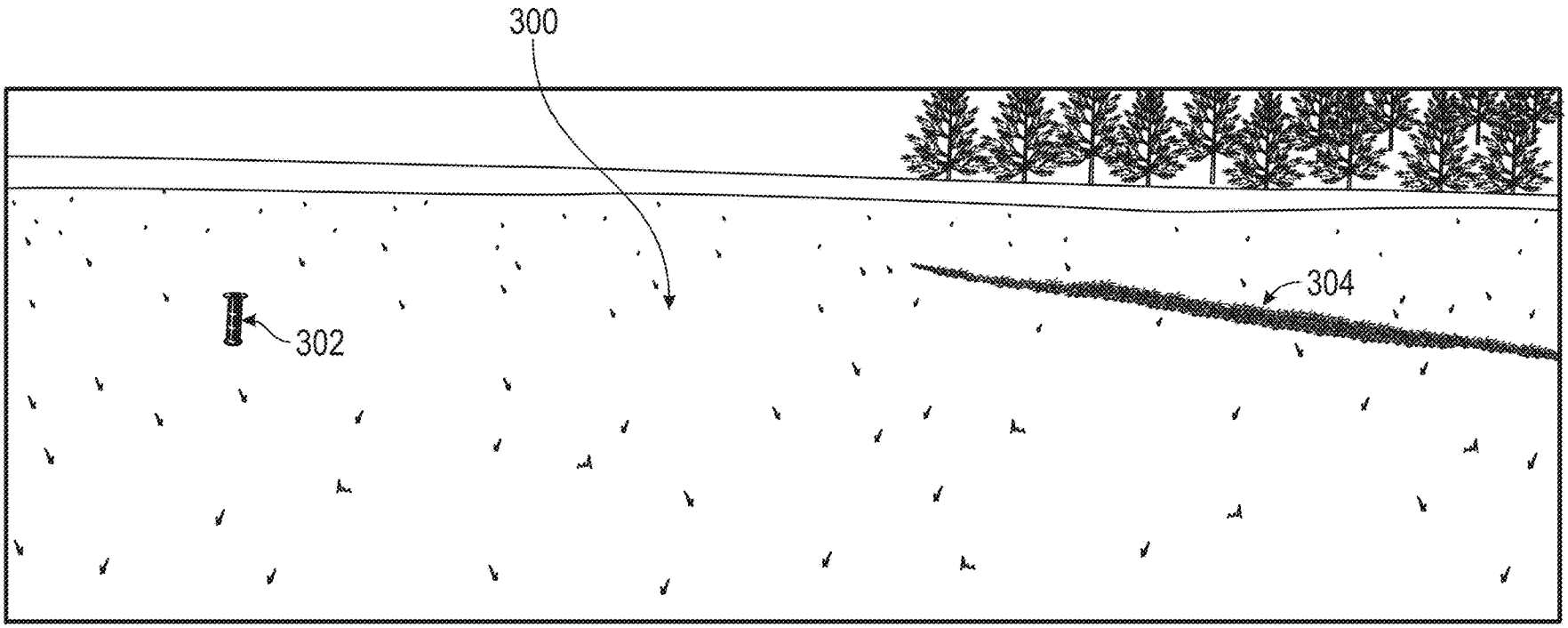
FIG. 33 shows a perspective view of an example agricultural field that includes at least one telescoping riser assembly and at least one raised area.
Figure 34:
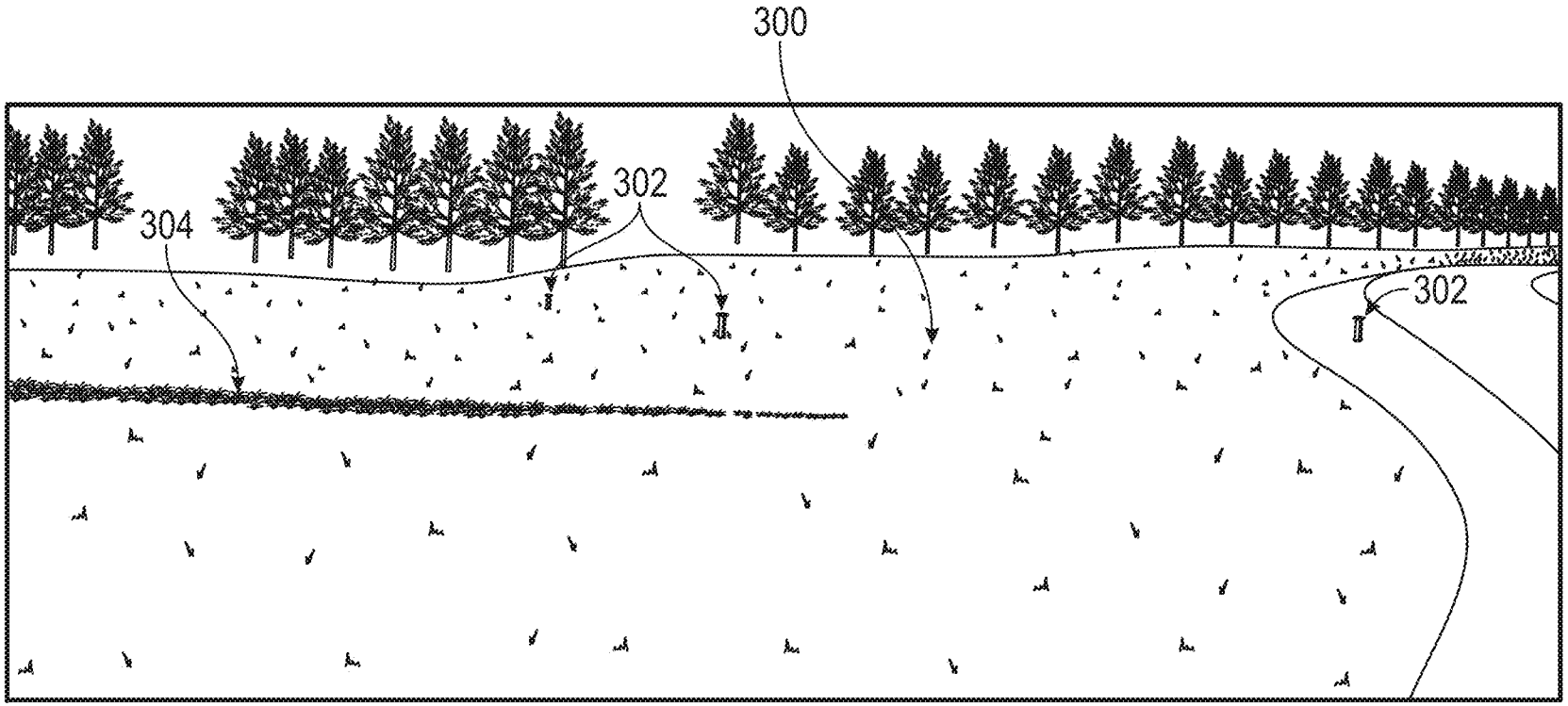
FIG. 34 shows a perspective view of another portion of the agricultural field of FIG. 33.

FIGS. 33 and 34 show perspective views of an agricultural field 300 that includes at least one telescoping riser assembly 302 and at least one raised area 304. FIG. 33 shows a portion of the field 300 and FIG. 34 shows another portion of the field 300 wherein the raised area 304 is the same in both FIGS. 33 and 34.

The agricultural field 300 of FIGS. 33 and 34 can be any suitable agricultural field. Each telescoping riser assembly 302 shown in FIGS. 33 and 34 can be the telescoping riser assembly 10 described herein. Each telescoping riser assembly 302 shown in FIGS. 33 and 34 are different telescoping riser assemblies configured in the same agricultural field 300.

The agricultural field 300 can comprise one or more telescoping riser assemblies 302. For example, the agricultural field of FIGS. 33 and 34 could include six telescoping riser assemblies 302 according to various embodiments. The agricultural field 300 could comprise zero to N telescoping riser assemblies 302 wherein N is any number greater than zero.

The agricultural field 300 can comprise one or more raised areas 304. The agricultural field 300 of FIGS. 33 and 34 shows a single raised area 304. The raised area 304 could be any sort of projection of the ground such as a levy, berm, mound, heap, and the like. Each of the telescoping riser assemblies 302 can be configured in particular locations around the raised area 304. Each telescoping riser assembly 302 can be any suitable distance from the raised area 304. According to some embodiments, each telescoping riser assembly 302 can be positioned forty feet from the raised area 304. According to some embodiments, the portion(s) of the agricultural field 300 that are not raised area(s) are lower than the raised area(s) 304 forming valleys and/or low areas. Each of the telescoping riser assemblies 302 can be positioned in such a valley and/or low area. Each valley and/or low area can include one or more telescoping riser assemblies 302. For example, according to some embodiments, six telescoping riser assemblies 302 can be positioned in each valley and/or low area of the agricultural field 300. According to some embodiments, the raised area(s) 304 can be constructed so that water can be directed to collect in the valley(s) and/or low area(s) of the agricultural field 300 wherein the water can be drained by the telescoping riser assemblies 302. Each of the telescoping riser assemblies 302 in the agricultural field 300 can be spaced to synergistically work together to drain water and/or control erosion.

It should be noted that any slidable connection mentioned herein may be established through the use of one or more suitable slidable elements, including: a friction fit on a slip (non-stick) surface, guides, tracks, piston(s), shaft(s), sleeve(s), collar(s), ball bearing(s), actuator(s), linkage(s), pivot(s), and/or the like. According to some embodiments, any slidable connection mentioned herein only allows a component to slide in one dimension (i.e. linearly) with respect to another component. Yet, it is to be appreciated some minor relief in a second dimension can be to mitigate wear, tear, or failure of slidable components and/or elements. To that end, oils, grease, lubricants, antistatic agents, and/or other non-viscous fluids or devices can be applied where wear and tear is expected to further mitigate the same over time.

It should be mentioned that any connection, attachment, and/or fastening mentioned herein may make use of screw(s), nut(s), bolt(s), pin(s), rivet(s), staple(s), washer(s), grommet(s), latch(es) (including pawl(s)), ratchet(s), clamp(s), clasp(s), flange(s), tie(s), adhesive(s), weld(s), any other known fastening mechanism(s), or any combination thereof to facilitate fastening, connection, and/or attachment.

Therefore, as understood from the present disclosure, the drain riser assembly/telescoping riser assembly described herein provides proper water drainage from an agricultural field while simultaneously improving a farmer's effectiveness and efficiency in performing agricultural activities and also improving a farmer's financial bottom line as compared to the prior art. The telescoping riser assembly allows a farmer to not have to navigate and/or steer around a riser extending up from the ground when performing an agricultural activity. For example, when performing an agricultural activity, the farmer can retract the top riser of each telescoping riser assembly into the underground piping and/or into the ground such that the farmer does not need to navigate agricultural equipment around the riser assembly when performing an agricultural activity. This saves the farmer time, effort, and money. The farmer can perform the agricultural activity with fewer passes through the agricultural field while maintaining a wide swath which leads to decreasing the time and fuel needed to perform said agricultural activity. Therefore, the farmer can cut costs related to fuel consumption and/or wages paid to hired laborers. Additionally, the farmer can maximize revenue by maximizing yield. If the farmer had to navigate around the riser assemblies, such as in the prior art, this would lead to a decrease in yield based on the fact that the agricultural activity (such as planting, harvesting, and the like) would be negatively affected due to having curved and/or missing rows. Thus, since the top riser of the telescoping riser assembly described herein can be retracted into underground piping and, thus, does not need to be navigated around when performing an agricultural activity, crops can be planted in straight rows such that the farmer's yield is not negatively affected, but rather, is maximized.

Maximization of Yields Leads to Maximization of Revenue.

Additionally, the telescoping nature of the top riser of the riser assembly combined with the fact that the riser assembly includes a main cap, provides protection for aspect(s) of the riser assembly as well as prevents debris from entering aspect(s) of the riser assembly. When the riser assembly is retracted into the underground piping, the main cap is flush with the ground and/or fits firmly to the ground and acts as a sort of shield. Thus, aspects of the telescoping riser assembly, including the underground piping, are protected from being damaged by agricultural equipment when an agricultural activity is performed. Additionally, the telescoping nature of the top riser combined with the main cap of the riser assembly prevents debris from entering aspect(s) of the riser assembly including the underground piping. Unwanted debris entering the riser assembly can cause the riser assembly to operate less effectively and/or can cause damage to aspects of the riser assembly. Therefore, preventing debris from entering aspects of the riser assembly saves time, effort, and money in terms of cleaning debris out of aspects of the riser assembly, repairing aspects of the riser assembly, and/or replacing aspects of the riser assembly. Additionally, debris in the telescoping riser assembly and/or damage to aspects of the telescoping riser assembly can cause the telescoping riser assembly to not function properly and/or to not function to the best of its ability. This can lead to poor water drainage which can have negative effects on yields ultimately resulting in negative effects on the farmer's revenue. Thus, the telescoping riser assembly described herein provides advantages over the prior art.

Furthermore, the telescoping riser system described herein allows a farmer to determine and/or monitor the location of each telescoping riser assembly that is part of the system. Thus, a farmer can pinpoint the exact location of each telescoping riser assembly in a particular agricultural field and/or across multiple agricultural fields. The farmer can use any sort of HMI to determine where each telescoping riser assembly is located. Therefore, when the farmer wants to extend and/or retract the telescoping riser assemblies in a particular field, much time, effort, and money is saved by knowing the location of each telescoping riser assembly.

It is to be appreciated that the telescoping riser system described herein can be used with any number of orifices in either the bottom riser or the top riser, depending on the application. For example, the bottom riser has historically included an orifice to comply with governmental regulations. This configuration can thus still be used. However, it may be more beneficial to eliminate the orifice entirely so as to not restrict water flow in the area in which the orifice used to be. Moreover, the orifice can be beneficially employed in areas of the top riser where water is desired to be restricted, without needlessly restricting water flow in a way which would cause a detrimental effect such as a partial or total blockage of intended fluid flow.

Furthermore, the telescoping riser system described herein can include indicators that suggest to farmers how to use and/or install the telescoping riser system. For example, installation instructions can be included at the time the telescoping riser system is sold. Additionally or in lieu thereof, visual indicators such as arrows, text, and the like, can be included on one or more components (such as the top cap) to indicate a particular step for installation or use (such as attaching the bottom riser to the top riser, indicating a direction of locking or unlocking, etc.).

From the foregoing, it can be seen that the present disclosure accomplishes at least all of the stated objectives.

LIST OF REFERENCE CHARACTERS

The following table of reference characters and descriptors are not exhaustive, nor limiting, and include reasonable equivalents. If possible, elements identified by a reference character below and/or those elements which are near ubiquitous within the art can replace or supplement any element identified by another reference character.

TABLE 1

| List of Reference Characters | |
|---|---|
| 10 | telescoping riser assembly/drain riser assembly |
| 12 | cylindrical member/top riser |
| 13 | first end of cylindrical member |
| 14 | vibration isolator |
| 15 | second end of cylindrical member |
| 16 | snap cap |
| 17 | bushing |
| 18 | main cap |
| 20 | first cut line |
| 22 | second cut line |
| 24 | first section of cylindrical member |
| 26 | second section of cylindrical member |
| 28 | third section of cylindrical member |
| 30 | protrusion of snap cap |
| 32 | aperture of cylindrical member |
| 34 | overmold of snap cap |
| 36 | connection member of main cap |
| 38 | length of first section of cylindrical member |
| 40 | combined length of first and second sections of cylindrical member |
| 42 | combined length of first, second, and third sections of cylindrical member/total length of cylindrical member |
| 44 | guide slot of cylindrical member |
| 46 | locking mechanism |
| 47 | diameter of cylindrical member |
| 48 | back of guide slot |
| 49 | diameter of guide slot |
| 50 | body of bushing |
| 51 | first end of bushing |
| 52 | second end of bushing |
| 53 | tab(s) of bushing |
| 54 | flange(s) of bushing |
| 55 | inner surface of bushing |
| 56 | rib of bushing |
| 57 | outer surface of bushing |
| 58 | rim of bushing |
| 60 | diameter of bushing (inclusive of the rim) |
| 62 | length/height of bushing |
| 64 | side wall(s) of snap cap |
| 66 | top of snap cap |
| 68 | bottom of snap cap |
| 70 | slot(s) of snap cap |
| 71 | diameter of snap cap |
| 72 | height of side wall(s) |
| 74 | total height of snap cap |
| 76 | body of main cap |
| 78 | top of the body of the main cap |
| 80 | bottom of the body of the main cap |
| 82 | raised portion of connection member |
| 84 | plate of connection member |
| 86 | leg(s) of connection member |
| 87 | end member(s) of each leg of connection member |
| 88 | diameter of main cap |
| 90 | diameter of plate of connection member |

TABLE 1-continued

| List of Reference Characters | |
|---|---|
| 92 | height of main cap |
| 94 | underground piping/bottom riser |
| 95 | length of underground piping/bottom riser |
| 96 | top of underground piping/bottom riser |
| 97 | bottom of underground |
| 98 | diameter of underground piping/bottom riser |
| 99 | tab of underground piping/bottom riser |
| 100 | aperture of underground piping/bottom riser |
| 102 | large separator |
| 104 | medium separator |
| 106 | small separator |
| 108 | inner wall of underground piping/bottom riser |
| 110 | outer wall of underground piping/bottom riser |
| 200 | telescoping riser system |
| 202 | one or more telescoping riser assemblies |
| 204 | human-machine interface (HMI) |
| 206 | user interface (UI) |
| 208 | positioning system |
| 209 | one or more electronic locators |
| 210 | controller |
| 212 | component(s) for communication |
| 213 | network |
| 214 | memory |
| 216 | database |
| 300 | agricultural field |
| 302 | telescoping riser assembly |
| 304 | raised area |

What is claimed is:

1. A drain riser assembly for use with water drainage from an agricultural field, the assembly comprising:

a cylindrical member;

a vibration isolator configured to slidingly interact with the cylindrical member;

a snap cap removably attachable to one end of the cylindrical member; and a main cap removably attachable to the snap cap;

wherein the cylindrical member comprises opposing guide slots;

wherein the snap cap comprises opposing slots wherein the slots of the snap cap are configured to slidingly interact with a back side of the guide slots of the cylindrical member.

2. The assembly of claim 1, wherein the vibration isolator is a removable bushing comprising opposing tabs.

3. The assembly of claim 2, wherein the opposing guide slots of the cylindrical member are configured to slidingly engage the opposing tabs of the bushing.

4. The assembly of claim 2, wherein the bushing comprises a body having an outer surface and an inner surface, further wherein the bushing is configured to engage underground piping via the outer surface, and/or flange(s) thereof, and slidingly interact with the cylindrical member via the inner surface.

5. The assembly of claim 4, wherein when the bushing is engaged with the underground piping, the cylindrical member is capable of sliding relative to the bushing such that the cylindrical member is capable of telescopically extending from and retracting into the underground piping, further wherein a body of the main cap fits firmly to the ground when the main cap is attached to the snap cap, the snap cap is attached to the cylindrical member, and the cylindrical member is fully retracted into the underground piping.

6. The assembly of claim 1, wherein the cylindrical member comprises a locking mechanism that allows the cylindrical member to be locked in place relative to the vibration isolator.

7. The assembly of claim 1, wherein the snap cap comprises an overmold and the main cap comprises a connection member, further wherein the overmold and the connection member are capable of matingly engaging to attach the snap cap to the main cap.

8. The assembly of claim 1, wherein the cylindrical member comprises first, second, and third sections, further wherein the first and second sections are separated via a first cut line and the second and third sections are separated via a second cut line.

9. The assembly of claim 1, wherein the vibration isolator comprises one or more tabs integrally formed with underground piping.

10. The assembly of claim 9, wherein the cylindrical member is capable of sliding relative to the one or more tabs integrally formed with the underground piping such that the cylindrical member is capable of telescopically extending from and retracting into the underground piping, further wherein a body of the main cap fits firmly to the ground when the main cap is attached to the snap cap, the snap cap is attached to the cylindrical member, and the cylindrical member is fully retracted into the underground piping.

11. A telescoping riser system for use with water drainage from an agricultural field, the system comprising:

at least one drain riser assembly of claim 1, wherein each of the at least one drain riser assemblies is positioned in an agricultural field.

12. The system of claim 11, further comprising a human-machine interface (HMI) operationally connected to each of the at least one drain riser assemblies.

13. The system of claim 12, further comprising a positioning system operationally connected to each of the at least one drain riser assemblies and/or to the HMI to determine and/or monitor the location of each of the at least one drain riser assemblies.

14. A drain riser assembly for use with water drainage from an agricultural field, the assembly comprising:

a cylindrical member;

a vibration isolator configured to slidingly interact with the cylindrical member;

a snap cap removably attachable to one end of the cylindrical member; and a main cap removably attachable to the snap cap;

wherein the cylindrical member comprises opposing guide slots;

wherein the snap cap comprises opposing slots wherein the slots of the snap cap are configured to slidingly interact with a back side of the guide slots of the cylindrical member;

wherein the snap cap further comprises opposing protrusions and the cylindrical member comprises two or more apertures, further wherein each of the opposing protrusions are configured to engage one of the two or more apertures when the snap cap is attached to the cylindrical member.

* * * * *